US011208236B2

(12) United States Patent
Nussbaum

(10) Patent No.: US 11,208,236 B2
(45) Date of Patent: Dec. 28, 2021

(54) NESTABLE AND STACKABLE STRAIGHT WALL TOTE WITH EXPANDABLE AND COLLAPSIBLE BOTTOM STRUCTURE

(71) Applicant: ORBIS Corporation, Oconomowoc, WI (US)

(72) Inventor: Robert Guy Nussbaum, Oconomowoc, WI (US)

(73) Assignee: ORBIS Corporation, Oconomowoc, WI (US)

( * ) Notice: Subject to any disclaimer, the term of this patent is extended or adjusted under 35 U.S.C. 154(b) by 214 days.

(21) Appl. No.: 16/376,901

(22) Filed: Apr. 5, 2019

(65) Prior Publication Data

US 2019/0322416 A1 Oct. 24, 2019

Related U.S. Application Data

(60) Provisional application No. 62/660,648, filed on Apr. 20, 2018.

(51) Int. Cl.

| | |
|---|---|
| ***B65D 1/22*** | (2006.01) |
| ***B65D 21/04*** | (2006.01) |
| ***B65D 21/08*** | (2006.01) |

(52) U.S. Cl.

CPC ..... *B65D 21/048* (2013.01); *B65D 21/08* (2013.01)

(58) Field of Classification Search

CPC .... B65D 21/048; B65D 21/08; B65D 21/068; B65D 1/22; B65D 77/042

USPC ..... 206/503; 229/101; 220/8; 426/111

See application file for complete search history.

(56) References Cited

U.S. PATENT DOCUMENTS

| | | | | |
|---|---|---|---|---|
| 2,852,157 A | | 9/1958 | Frater | |
| 3,270,913 A | | 9/1966 | Bridenstine et al. | |
| 3,659,743 A | | 5/1972 | Box | |
| 4,027,796 A | | 6/1977 | Martin | |
| 4,205,749 A | | 6/1980 | Carroll et al. | |
| 4,316,540 A | | 2/1982 | Lapham | |
| 4,580,681 A | * | 4/1986 | Braun | B65D 59/00 206/506 |
| 4,823,955 A | | 4/1989 | Apps | |

(Continued)

FOREIGN PATENT DOCUMENTS

| | | | | |
|---|---|---|---|---|
| CA | 3040070 A1 | | 10/2019 | |
| GB | 1261883 | * | 1/1972 | B65D 21/068 |
| MX | 2019004563 A | | 10/2019 | |

OTHER PUBLICATIONS

ORBIS Employee, Photograph of what appears to be a European collapsing bottom container, taken on trip to Europe by an ORBIS Corporation Employee in 2011, 1 page.

*Primary Examiner* — Don M Anderson
*Assistant Examiner* — Elizabeth J Volz
(74) *Attorney, Agent, or Firm* — Greensfelder, Hemker & Gale, P.C.; Richard C. Himelhoch

(57) ABSTRACT

A nestable and stackable straight wall tote with an expandable bottom is provided. The tote includes a bottom wall connected to each of a first end wall, a second end wall, a first side wall and a second side wall by an expandable and collapsible linking portion. The expandable and collapsible linking portions allows for expanding the bottom portion of the tote outward to enable the tote to either stack on a like tote when expanded or nest with a like tote (when collapsed. The tote can include a lock mechanism in the bottom to keep the walls in an expanded position.

20 Claims, 29 Drawing Sheets

(56) References Cited

U.S. PATENT DOCUMENTS

| | | | | |
|---|---|---|---|---|
| D320,298 | S | 9/1991 | Apps et al. | |
| 6,868,979 | B2 | 3/2005 | Rader | |
| 7,267,227 | B2 | 9/2007 | Dubois et al. | |
| 7,370,771 | B2 | 5/2008 | Rader | |
| 7,669,713 | B2 | 3/2010 | Stahl | |
| 7,721,891 | B2 | 5/2010 | Dubois | |
| 7,784,615 | B2 | 8/2010 | Stahl | |
| 8,348,076 | B2 | 1/2013 | Rader et al. | |
| 10,053,262 | B2 | 8/2018 | Miller et al. | |
| 2007/0278223 | A1 | 12/2007 | Ficker | |
| 2018/0273245 | A1 | 9/2018 | Sommer | |
| 2019/0055059 | A1 | 2/2019 | McDade | |
| 2020/0331651 | A1* | 10/2020 | Swartz | B65D 1/22 |

* cited by examiner

NESTABLE AND STACKABLE STRAIGHT WALL TOTE WITH EXPANDABLE AND COLLAPSIBLE BOTTOM STRUCTURE

CROSS-REFERENCE TO RELATED APPLICATIONS

The present invention claims priority to and the benefit of U.S. Provisional Patent Application No. 62/660,648 filed Apr. 20, 2018, the contents of which are incorporated herein by reference.

FEDERALLY SPONSORED RESEARCH OR DEVELOPMENT

N/A

FIELD OF THE INVENTION

The present invention is directed to a nestable or, alternatively, stackable, straight wall tote with an expandable and collapsible bottom structure or portion.

DESCRIPTION OF THE PRIOR ART

Plastic totes typically include rigid side walls and have a static foot print. Depending on the slope of the side walls the containers can either stack with other like containers, or nest with other like containers.

The present invention provides a tote container that can be adjusted to stack or nest with other like containers as desired.

SUMMARY OF THE INVENTION

The present invention is directed to a tote style container having a bottom portion which can expand and collapse the lower portion of the end walls and side walls of the container. This allows the container to stack with other like containers when the bottom portion is expanded (i.e., typically when the containers are filled with goods or other items), and to nest with other like containers when the bottom portion is collapsed (i.e., when the containers are empty).

In accordance with one aspect of the invention, a nestable container with an expandable bottom structure comprises a rectangular top rim, a first end wall extending downward from a first end of the top rim, a second end wall extending downward from a second end of the top rim opposing the first end of the top rim, a first side wall extending downward from a first side of the top rim, and a second side wall extending downward from a second side of the top rim opposing the first side of the top rim. The container also comprises a bottom wall connected to a bottom portion of the first end wall by a first expandable and collapsible linking portion. The expandable and collapsible linking portion enables the bottom of the end wall to move to an expanded position where it can stack on a rim of a like container, and to a collapsed position where it can nest within a like container. As used herein, a "like" container means an identical container or a similar container having features and dimensions that allow the container of the present invention to stack or nest with the like container.

Similar to the first end wall, the bottom wall can also be connected to the second end wall by a second expandable and collapsible linking portion. Additionally, the bottom wall can be connected to the first side wall by a third expandable and collapsible linking portion, and to the second side wall by a fourth expandable and collapsible linking portion.

The container can also include a locking mechanism connected to the bottom wall. The locking mechanism can include a bottom plate and a rotatable lock coupled to the bottom plate. The rotatable lock can include a central dial, a first arm extending outward from the central dial, and a second arm extending outward from the central dial. Rotation of the dial causes the first and second arms to engage or disengage the first and second side walls. When engaged, the arms force the side walls into an expanded position by moving the bottom edges of the side walls outward. Each side wall can include a catch for engaging the end of the arm.

The locking mechanism can include a rotatable lock designed to engage the end walls, either instead of the side walls or in addition to the side walls (i.e., with extra arms). Alternatively, the end walls can be provided with tabs to allow one to manually move the bottom portion to an expanded or collapsed position.

The container can be formed from plastic, or other similar or suitable materials. Additionally, the container can include other features or structures to provide strength or stability. For example, the bottom wall can include a plurality of downwardly extending ribs. Similarly, the rim and/or the end walls and side walls can also include outwardly extending ribs. Additionally, the container can include an upper band to support the rim portion of the container.

The container includes a first gap between the first end wall and the first side wall. The first gap has a first width proximate a bottom of the first end wall and a bottom of the first side wall when the bottom portion of the first end wall and the first side wall are expanded. The first gap also has a second width proximate a top of the first end wall and a top of the first side wall. The first width is greater than the second width.

In accordance with another aspect of the invention, a nestable container with an expandable and collapsible bottom portion comprises a rectangular bottom wall, a first end wall connected to a first side of the bottom wall by a first expandable and collapsible linking portion, a second end wall connected to a second side of the bottom wall by a second expandable and collapsible linking portion, a first side wall connected to a third side of the bottom wall by a third expandable and collapsible linking portion and a second side wall connected to a fourth side of the bottom wall by a fourth expandable and collapsible linking portion. The container can also include a rectangular rim connected to a top portion of the first end wall, a top portion of the second end wall, a top portion of the first side wall and a top portion of the second side wall.

The expandable and collapsible linking portions can each include a first linking segment and a second linking segment connected to the first linking segment by a pivot portion. The first linking segment is connected to a bottom edge of an end or side wall by another pivot portion. The linking portion can include an interior vertical wall segment which is connected to the bottom wall by another pivot portion.

Other features and advantages of the invention will be apparent from the following specification taken in conjunction with the following Figures.

BRIEF DESCRIPTION OF THE DRAWINGS

To understand the present invention, it will now be described by way of example, with reference to the accompanying drawings in which.

DETAILED DESCRIPTION

Figure 1A:
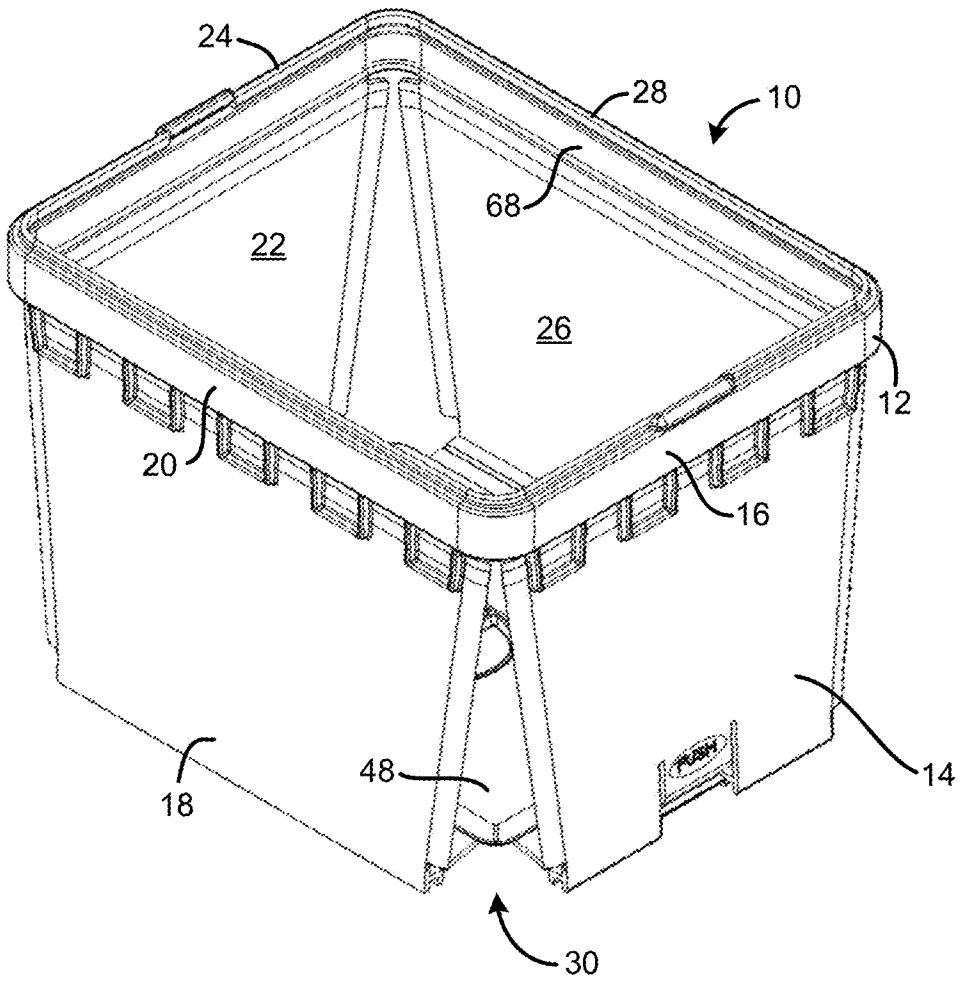
FIG. 1A is a perspective view of a container with an expandable bottom portion in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Directional or positional words or phrases (e.g., up, top, right, downwardly, etc.) are used herein to describe the invention as it is shown in the Figures and as typically positioned when used. Such words or phrases are not meant to limit the invention to being in such positions.

A nestable and stackable container 10 having an expandable and collapsible bottom portion is illustrated in FIGS. 1-18. The container 10 includes a rectangular upper rim portion 12, a first end wall 14 extending downward from a first end 16 of the rim portion 12, a first side wall 18 extending downward from a first side 20 of the rim portion 12, a second end wall 22 extending downward from a second end 24 of the rim portion 12, and a second side wall 26 extending downward from a second side 28 of the rim portion 12.

FIG. 1A shows the container 10, with the bottom portion of the container 10 expanded outward. As evident in this Figure, other than at the rim portion 12, the side edges of the end walls 14, 22 and side walls 18, 26 do not touch. Instead a gap 30 is formed between each adjacent end wall and side wall. The gap 30 has a narrower width near the rim portion 12. The width of the gap 30 widens toward the bottom portion of the container when the bottom portion is expanded outward (when collapsed, the width could be consistent throughout the height of the end walls and side walls, or non-existent, i.e., the edges could touch or overlap).

Figure 2:
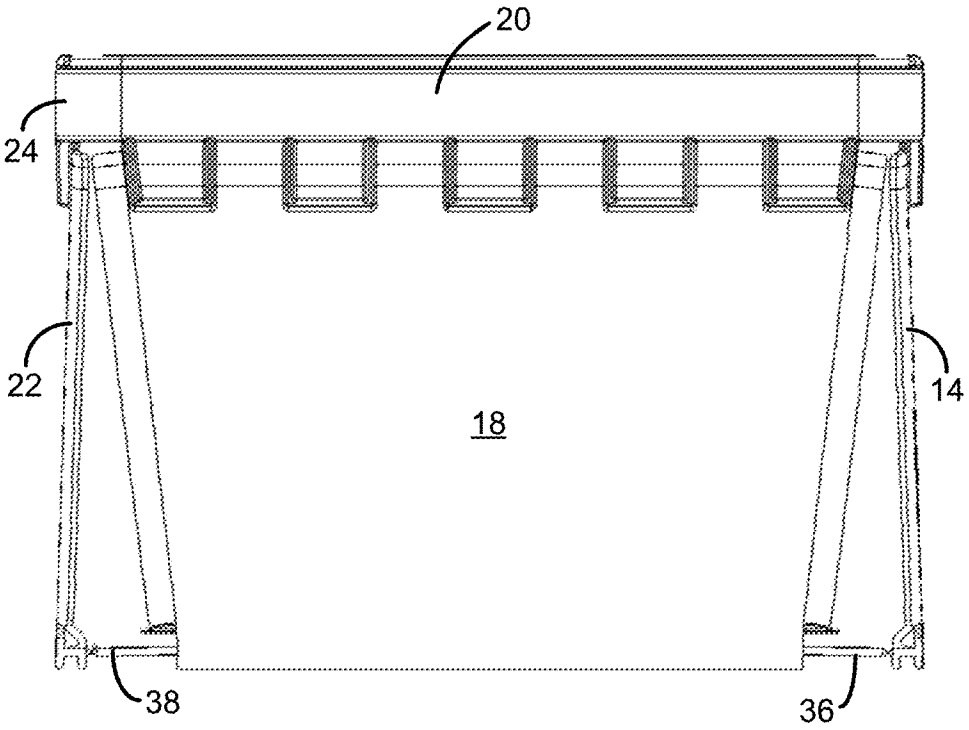
FIG. 2 is a side plan view of the container of FIG. 1.
Figure 3:
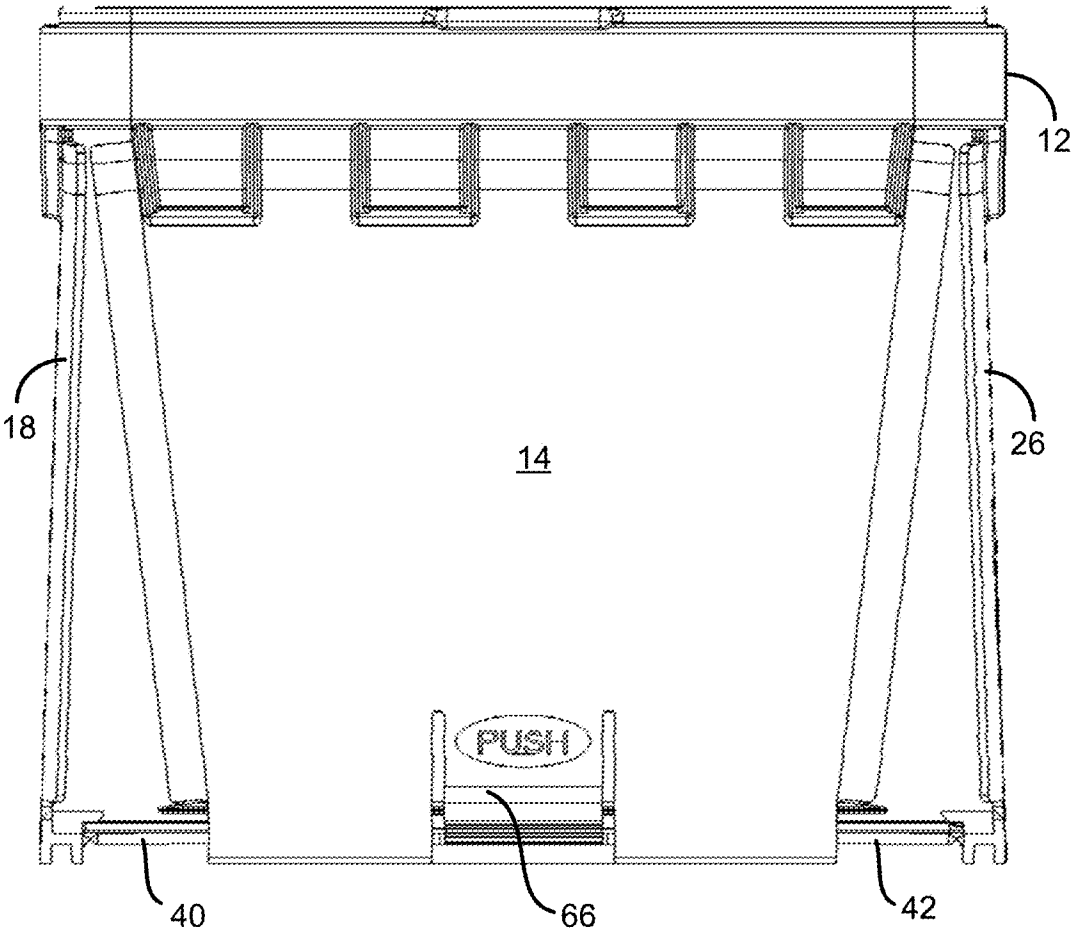
FIG. 3 is an end plan view of the container of FIG. 1.
Figure 4:
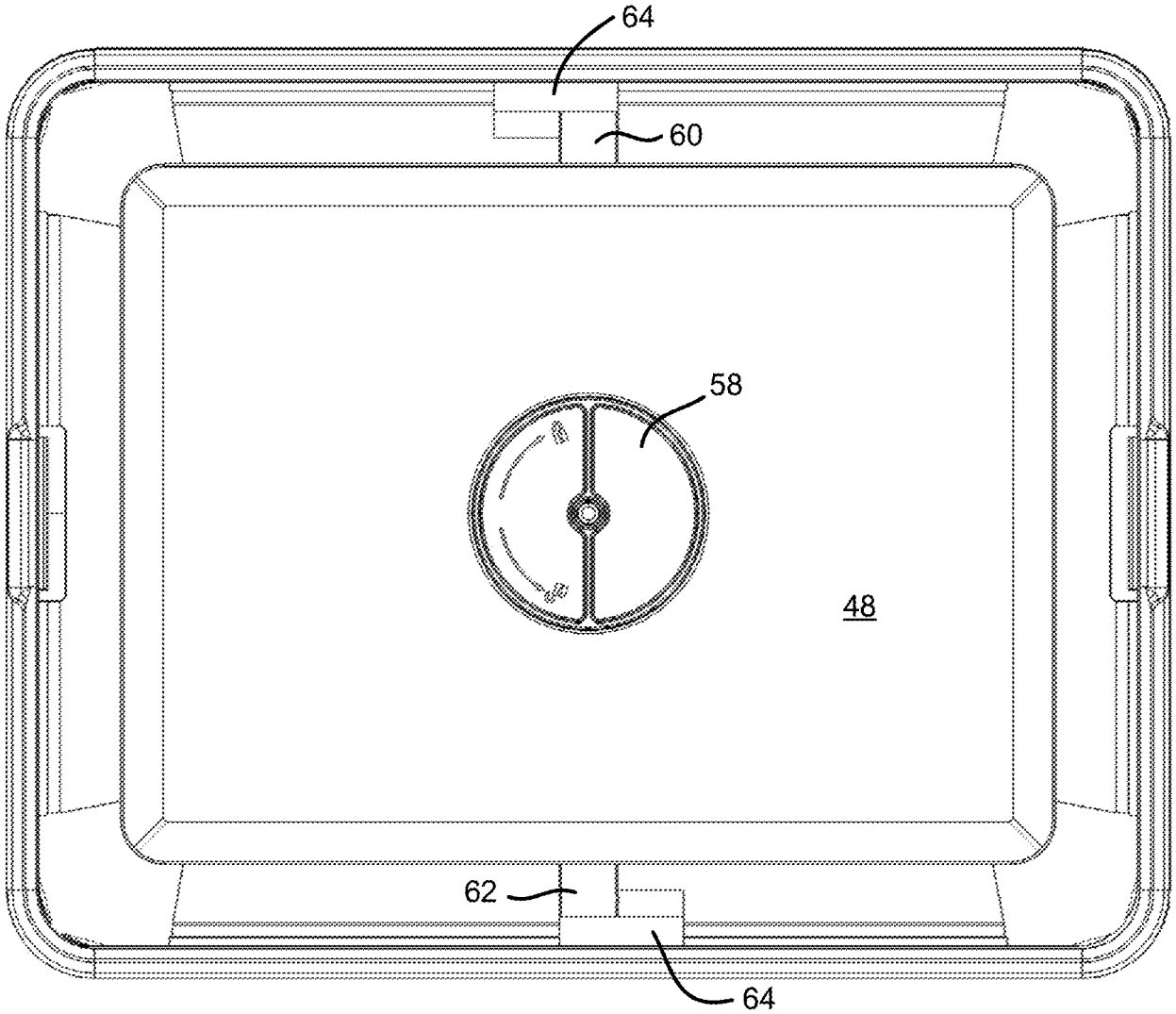
FIG. 4 is a top plan view of the container of FIG. 1.
Figure 5:
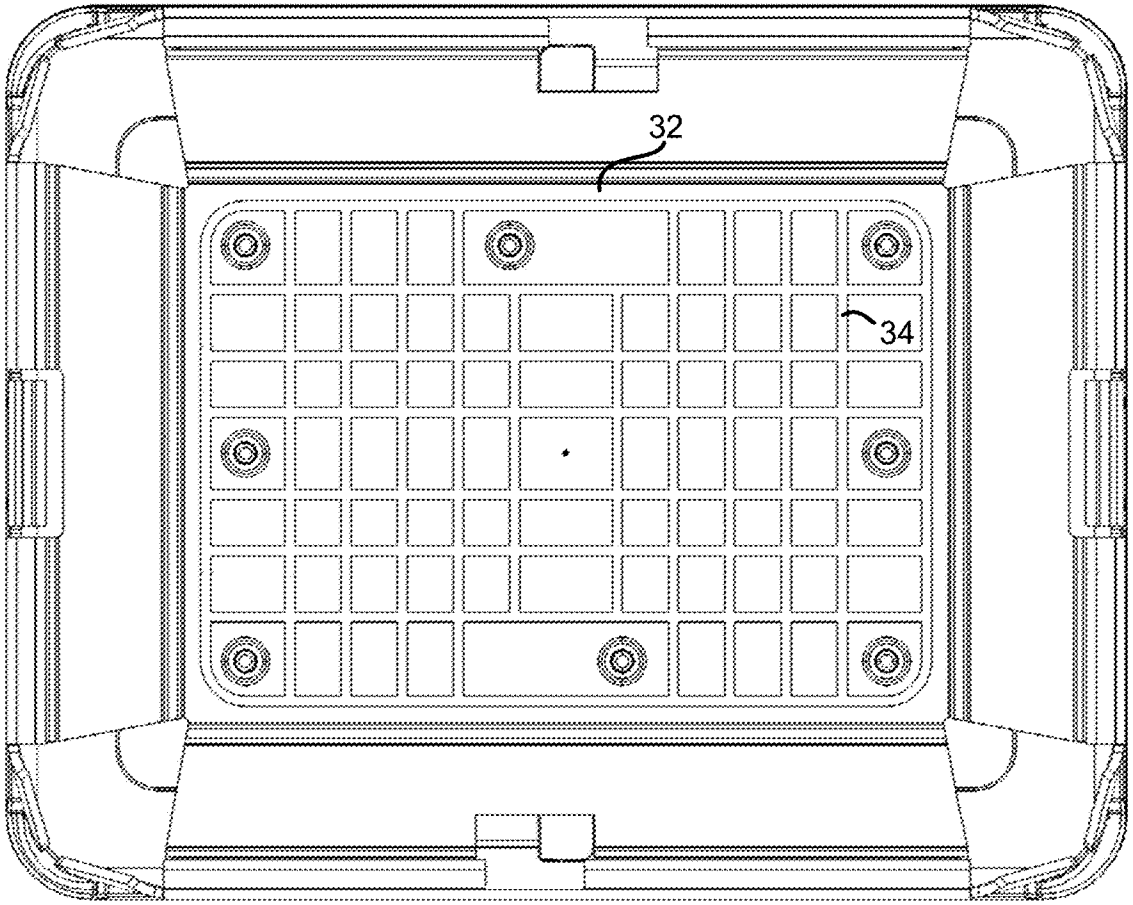
FIG. 5 is a bottom plan view of the container of FIG. 1.
Figure 6:
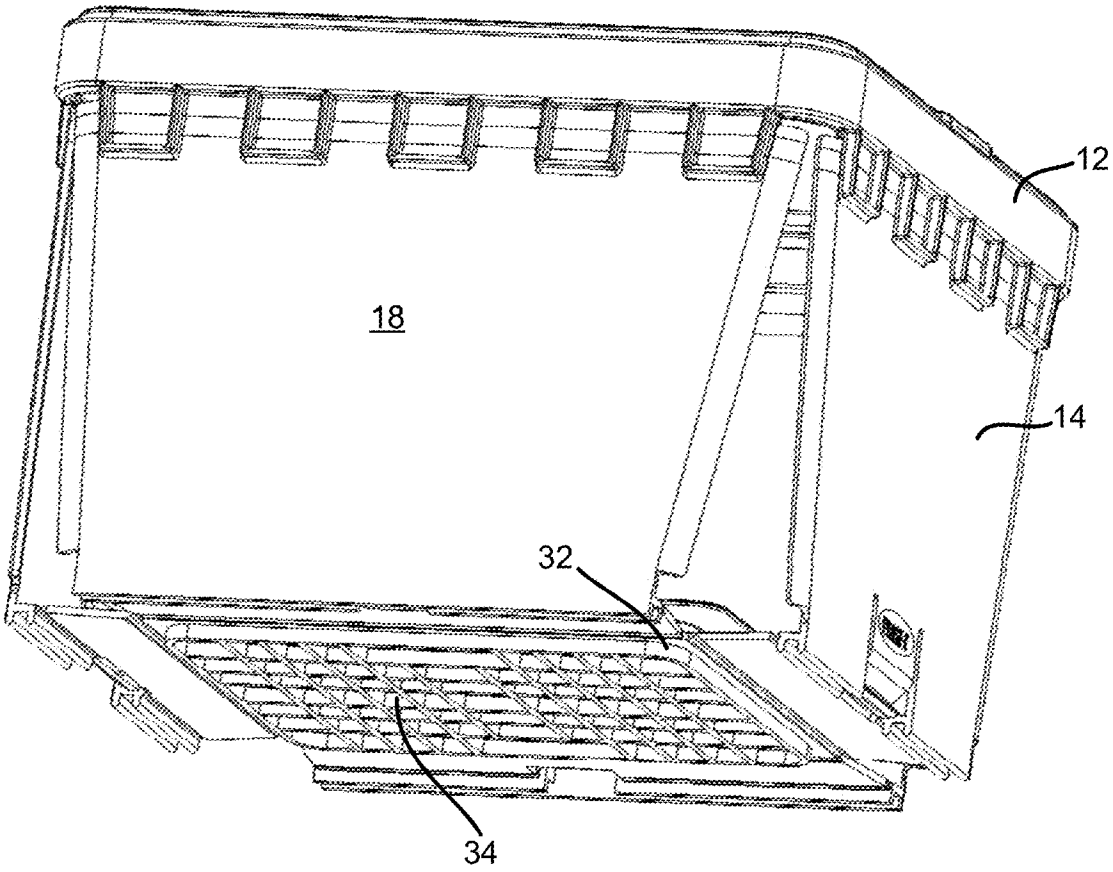
FIG. 6 is a bottom perspective view of the container of FIG. 1.
Figure 7:
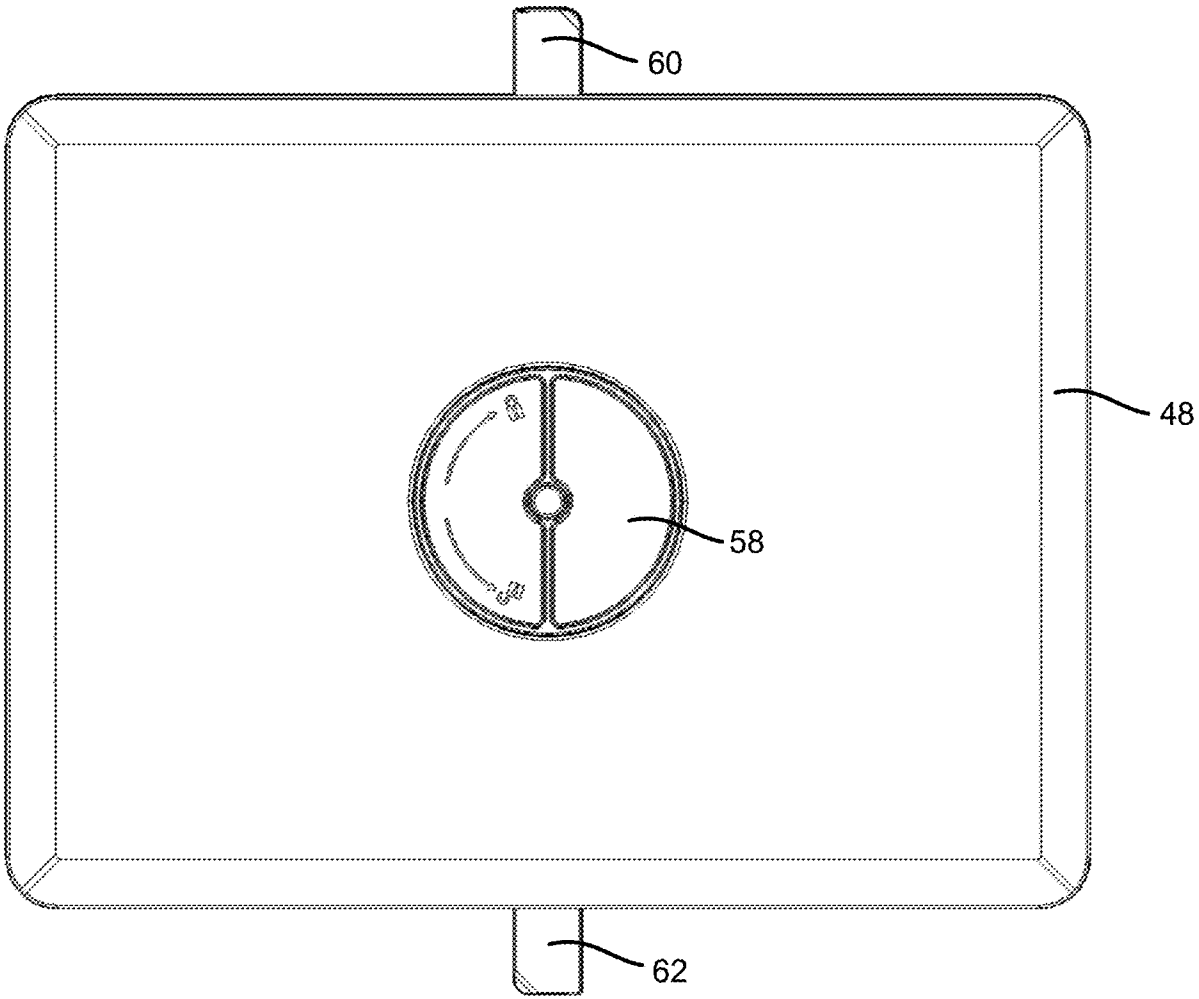
FIG. 7 is a top plan view of a bottom plate and rotating lock of the container of FIG. 1.
Figure 8A:
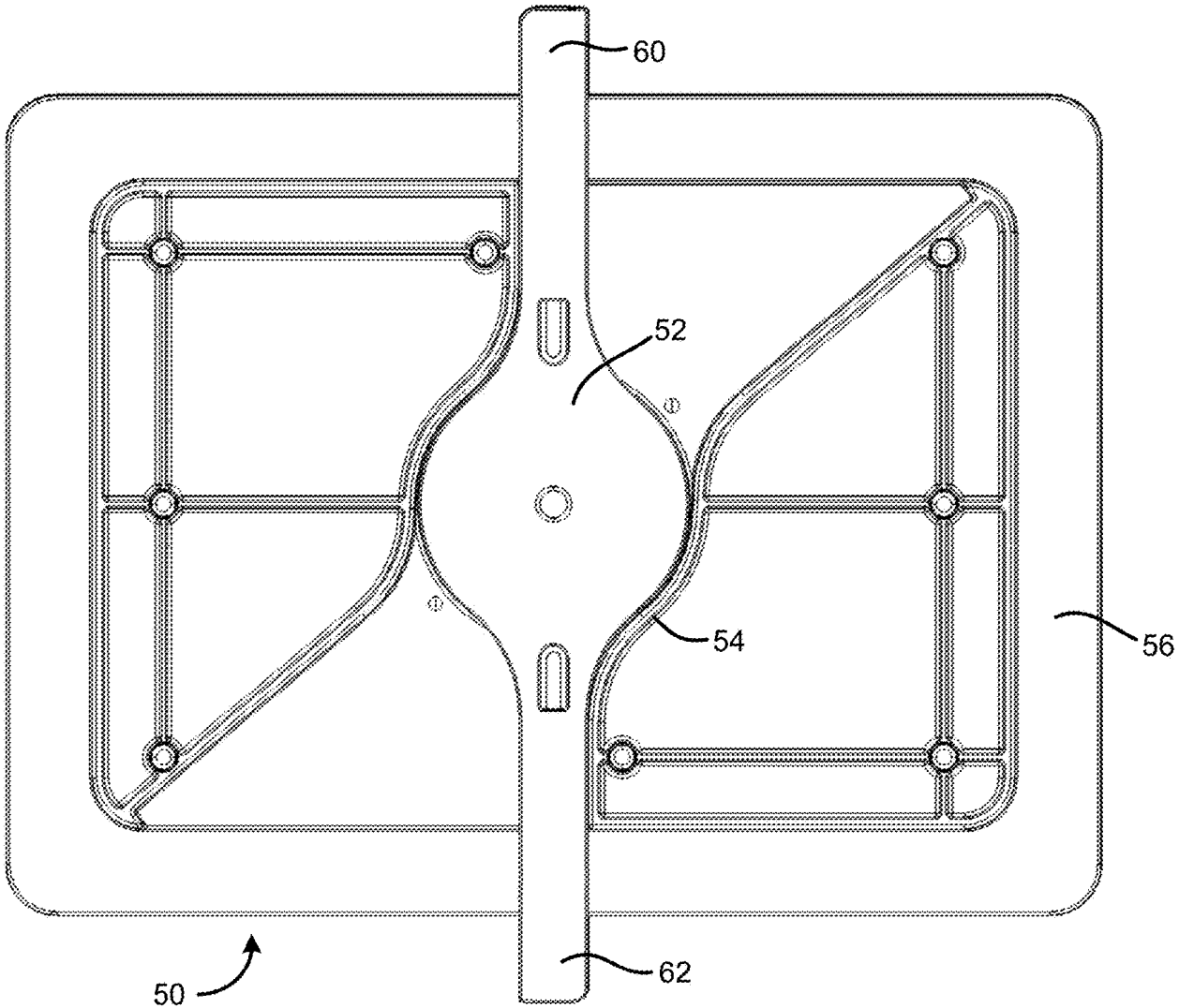
FIG. 8A is a bottom plan view of the bottom plate and rotating lock of the container of FIG. 1.
Figure 8B:
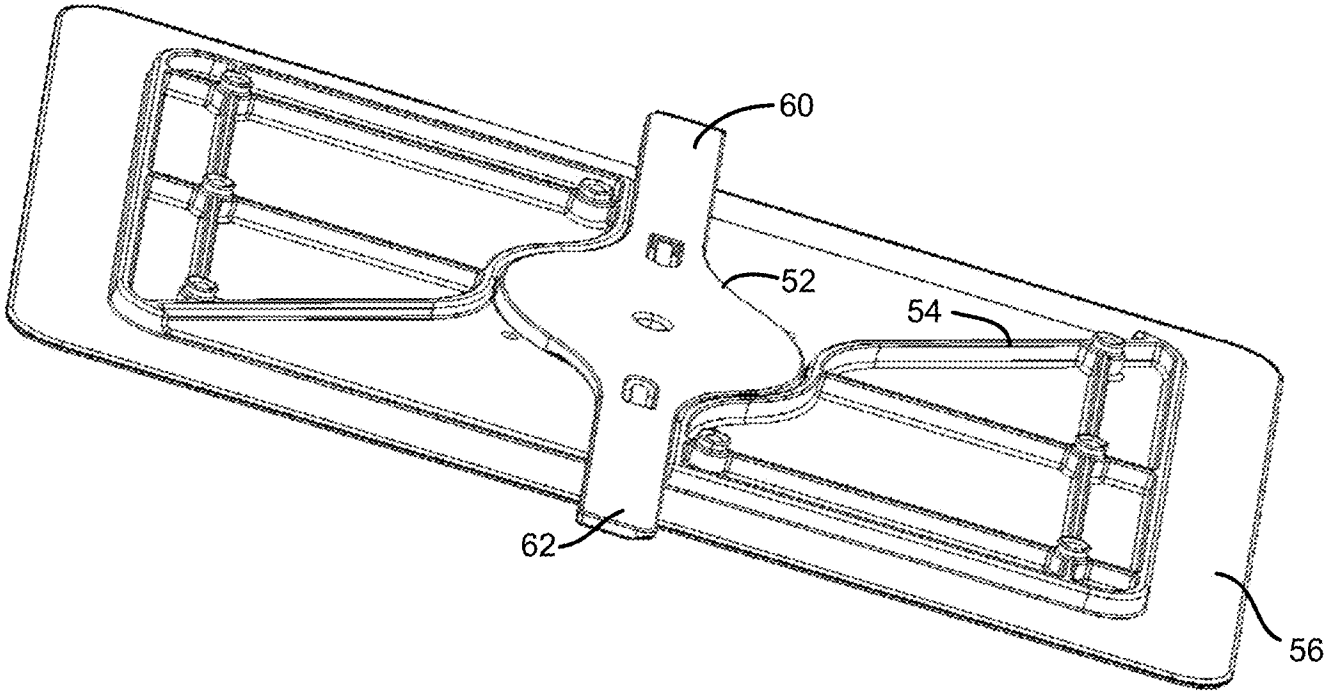
FIG. 8B is a bottom perspective view of the bottom plate and rotating lock of the container of FIG. 1.
Figure 9:
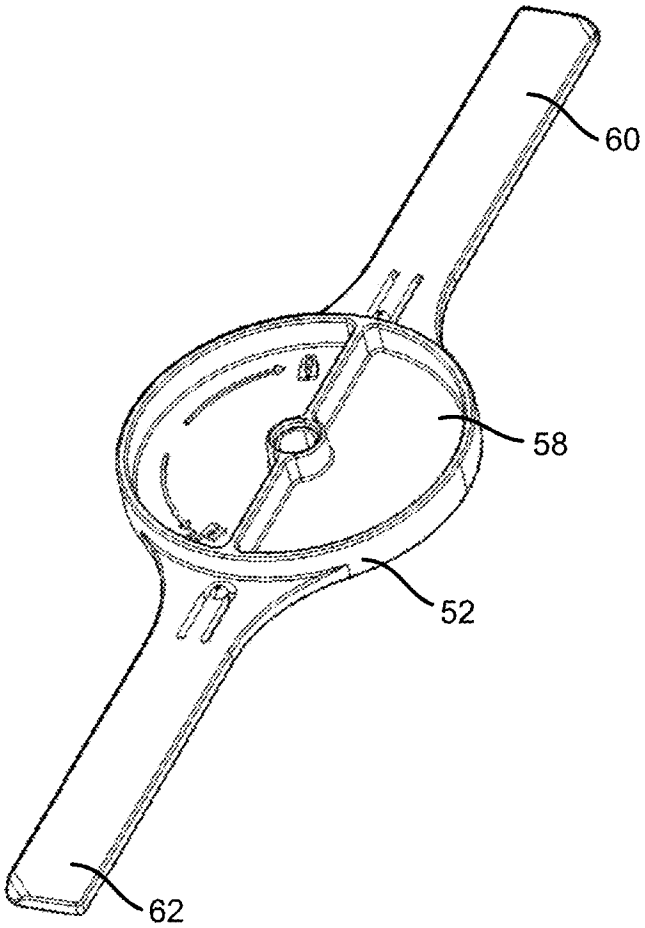
FIG. 9 is a top view of the rotating lock of the container of FIG. 1.

Referring to FIGS. 5 and 6, the container 10 includes a rectangular bottom wall 32 having a plurality of downwardly extending ribs 34. As shown in FIG. 2, the bottom wall 32 is connected to a bottom edge of the first end wall 14 by a first expandable and collapsible linking portion 36. The bottom wall 32 is similarly connected to the bottom edge second end wall 22 by a second expandable and collapsible linking portion 38. As shown in FIG. 3, the bottom wall 32 is connected to the bottom edge of the first side wall 18 by a third expandable and collapsible linking portion 40, and to the bottom edge of the second side wall by a fourth expandable and collapsible linking portion 42.

Figure 1B:
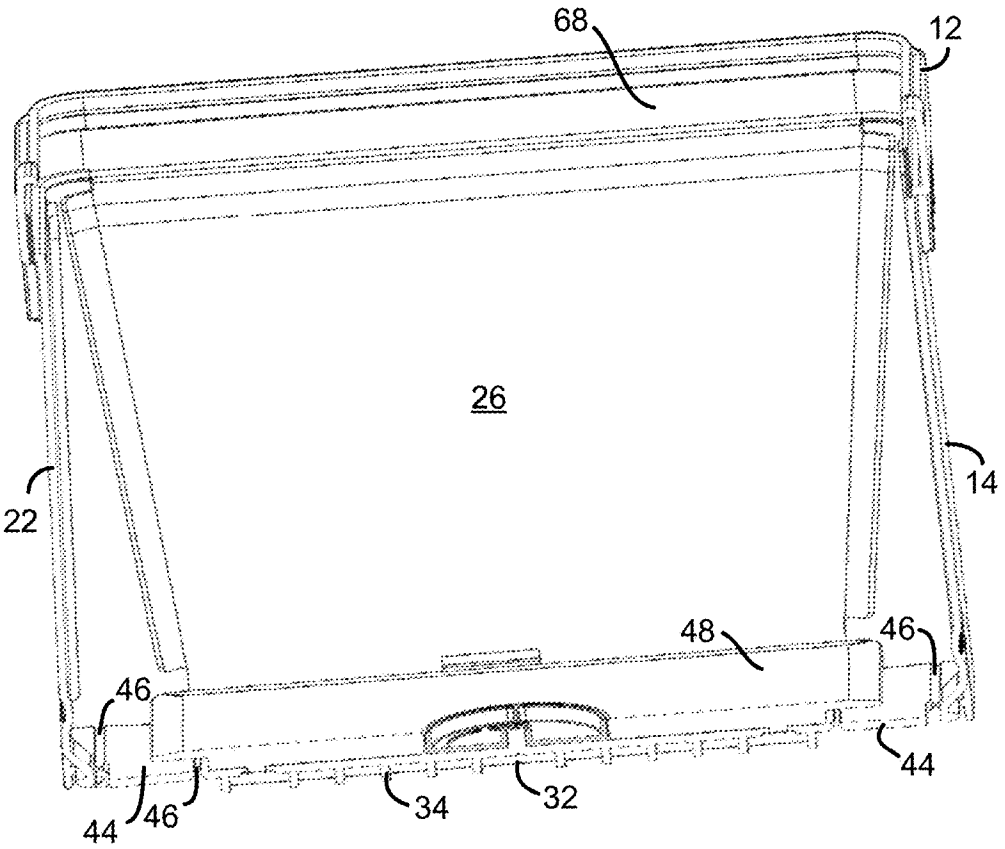
FIG. 1B is a perspective cross-sectional view between the first end wall and the second end wall of the container of FIG. 1.
Figure 1C:
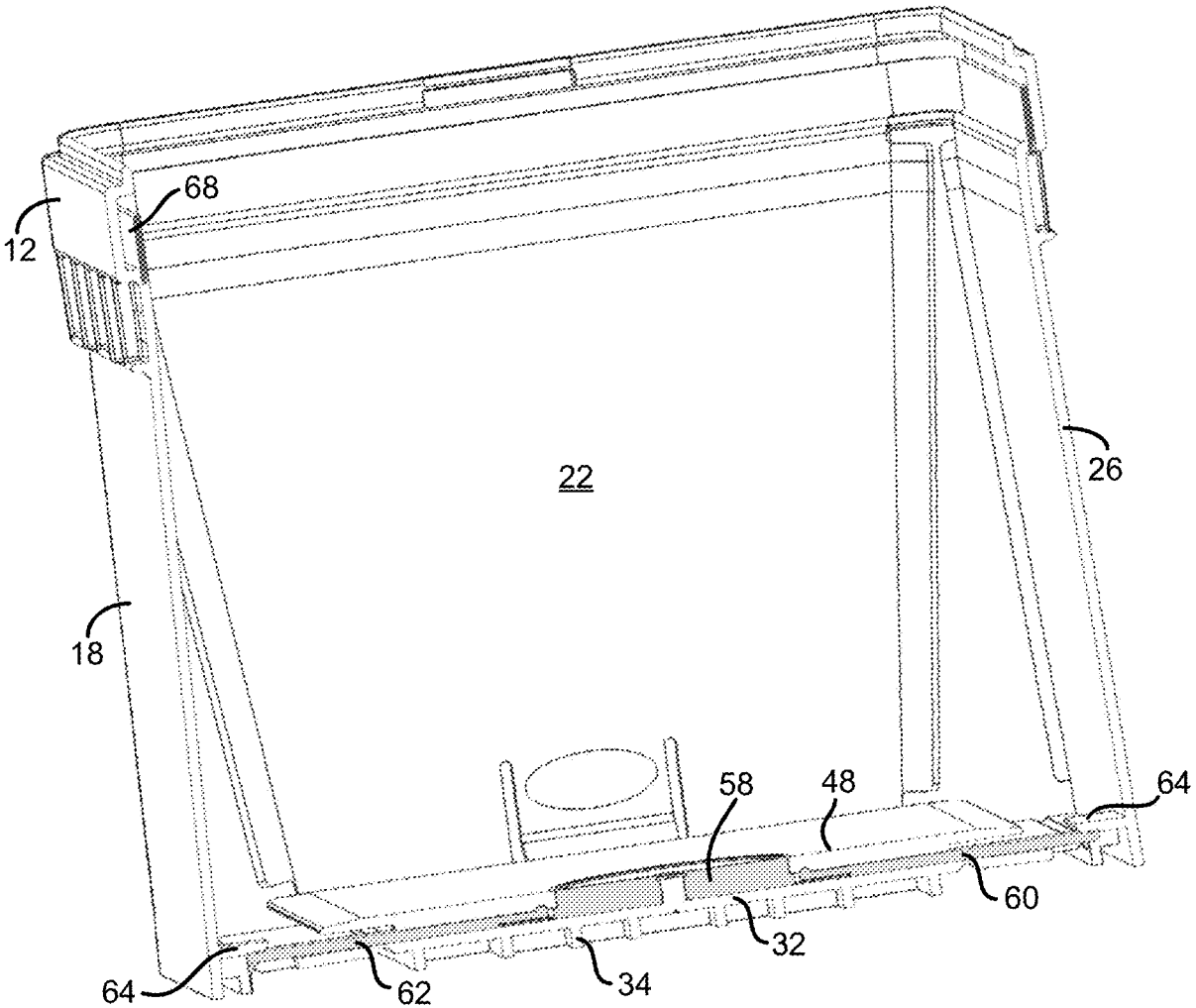
FIG. 1C is a perspective cross-sectional view between the first side wall and the second side wall of the container of FIG. 1.

Referring to FIGS. 1B and 1C, each of the expandable and collapsible linking portions 36, 38, 40, 42 connecting the bottom wall 32 to the bottom edge of the end and side walls 14, 22, 18, 26, respectively, is formed from one or more segments of material 44 connected by pivot portions 46. The linking segments 44 are rectangular strips of material (e.g., plastic) that, when expanded, are planar with and effectively extend the bottom wall. The pivot portions 46 are weakened, or thinned or scored portions of plastic on one or more sides of the linking segments that allow the linking segment (or connection to the end wall, side wall or bottom wall) to flex, bend or pivot at such points. This allows the linking segments and pivot portions to (at least partially) fold up—like an accordion—when collapsed, and to flatten out when expanded.

The container 10 also includes a bottom plate 48 that sits on top of the bottom wall 32. The bottom plate 48 (shown in FIG. 4 and without the container in FIGS. 7-8B serves at least two functions. The bottom plate 48 provides a location for which to mount a bag (not shown) in the container 10. The bag can be mounted to the underside of the bottom plate 48.

The bottom plate 48 can also include a locking mechanism 50 for forcing the side walls 18, 26 into an expanded position. The locking mechanism 50 includes a rotatable lock 52 that cooperates with ribs 54 extending downward from the lower surface 56 of the bottom plate (see FIGS. 8A and 8B). The rotatable lock 52 (shown on its own in FIG. 9) includes a central dial 58, a first arm 60 extending outward from the central dial 58 and a second arm 62 extending outward from the central dial 58. Twisting or rotating the central dial 58, moves the first and second arms 60, 62 into a "locked" engaged positions with the side walls, or to an "unlocked" out of engagement position with the side walls 18, 26 (depending on the direction of rotation). Each of the side walls 18, 26 includes a catch 64 for capturing the end of the arms 60, 62 (see e.g., FIGS. 12A and 12B). When engaged with a side wall, the arm forces the lower portion of the side wall outward to an expanded position (thus expanding the bottom portion of the container 10).

The end walls 14, 22 can be manually adjusted to an expanded or collapsed position. Each of the end walls 18, 22 includes a "Push" tab 66 to facilitate such movement. While the preferred rotatable lock 52 includes two arms, it can be formed with additional arms to contact the end walls.

Figure 10:
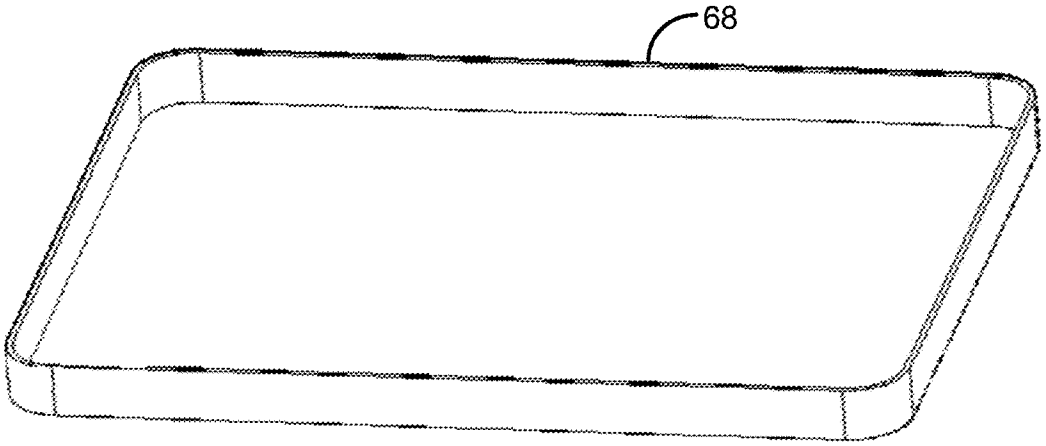
FIG. 10 is a perspective view of a top band of the container of FIG. 1.
Figure 11A:
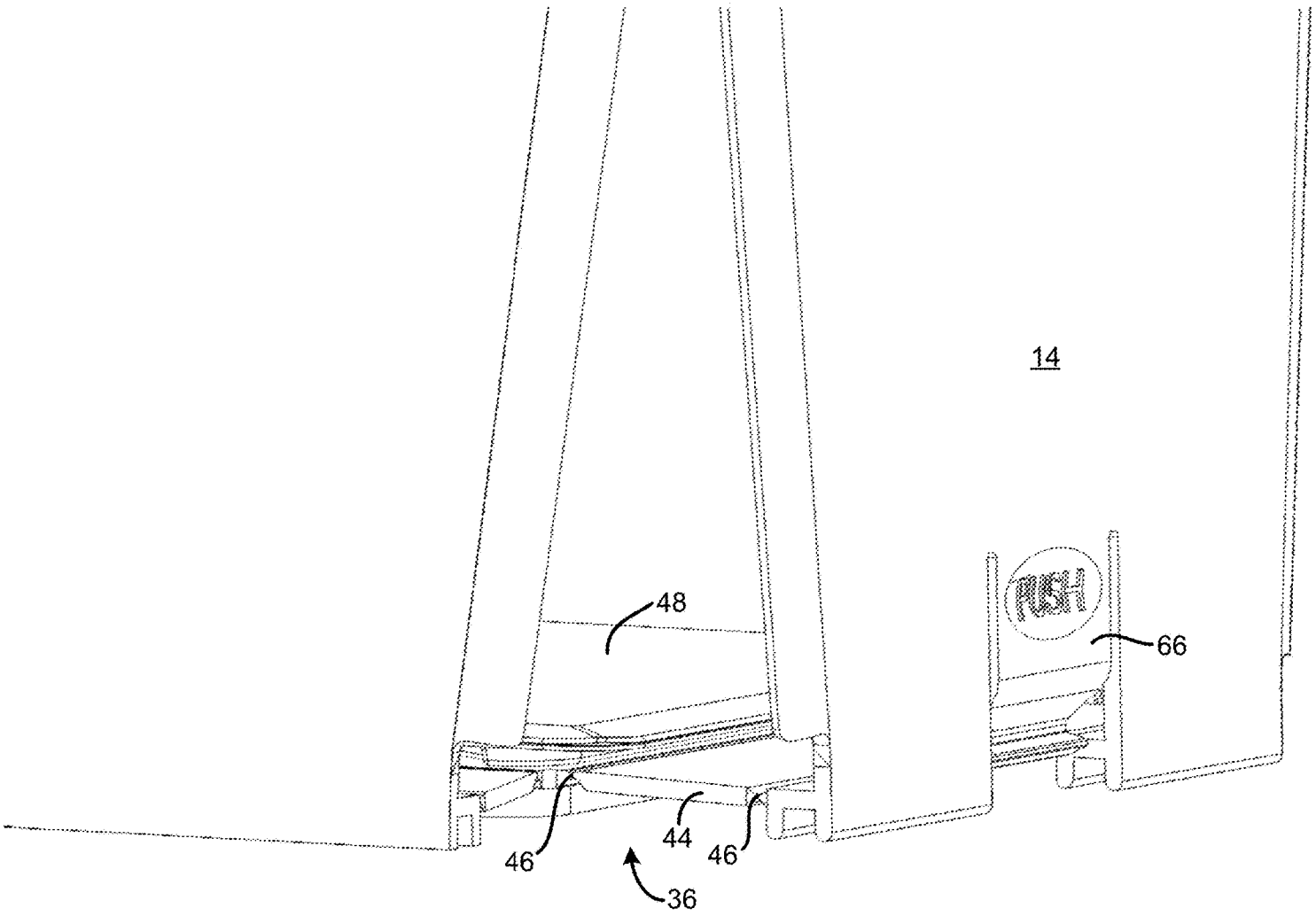
FIG. 11A is an enlarged perspective view of a corner portion and end wall of the container of FIG. 1.
Figure 11B:
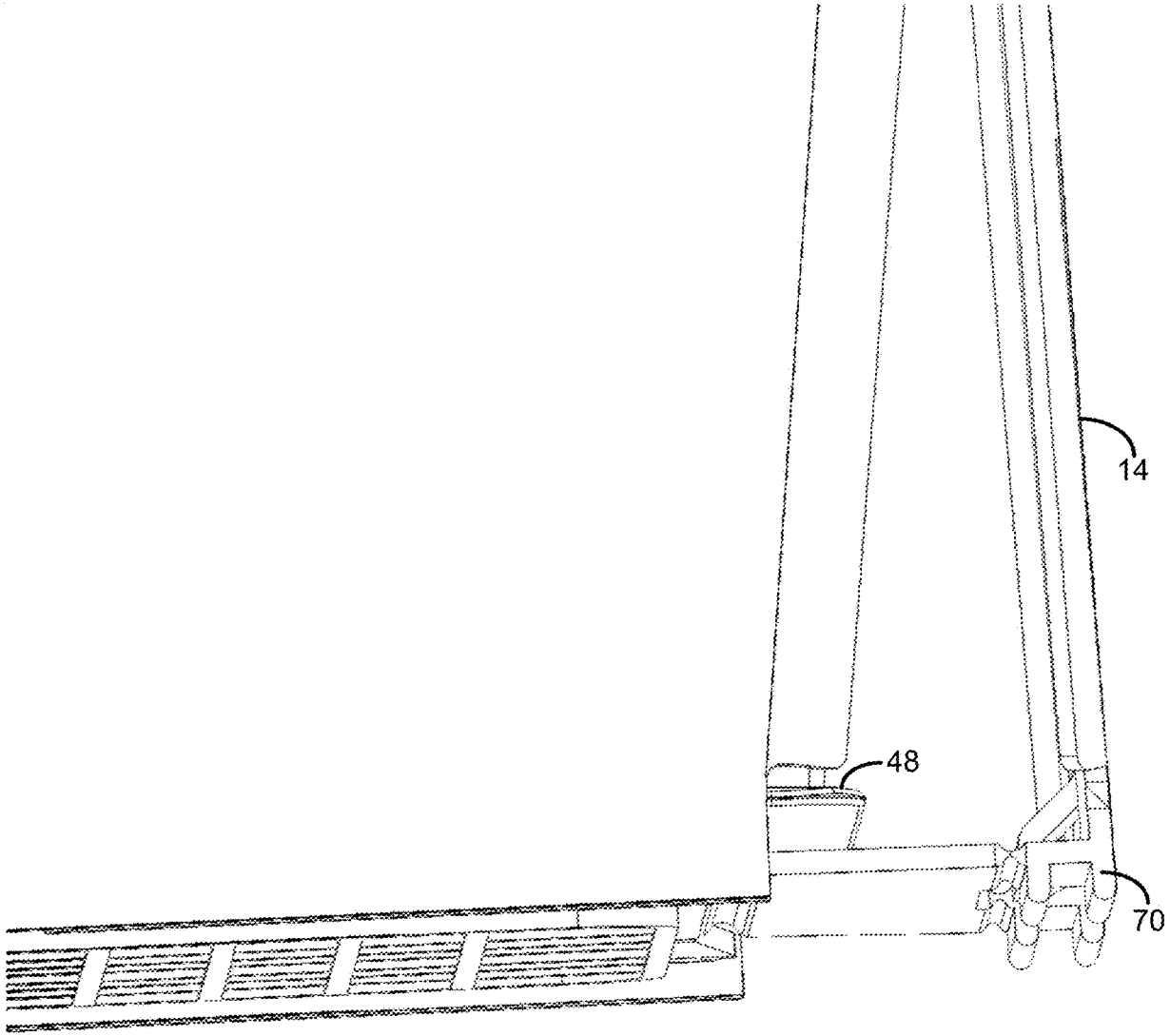
FIG. 11B is an enlarged perspective view of the corner portion and end wall of FIG. 11A from a lower angle.
Figure 12:
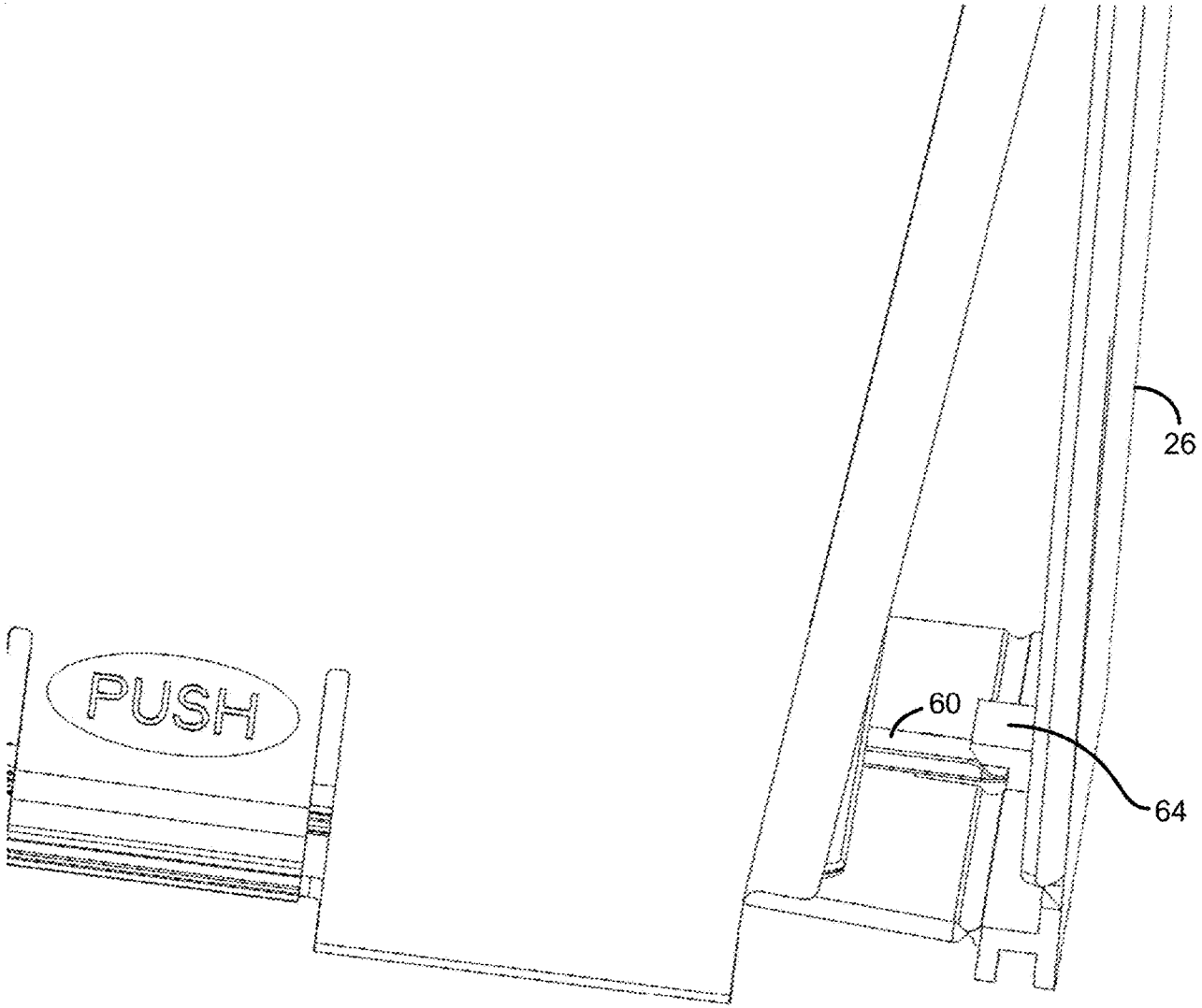
FIG. 12 is an enlarged perspective view of a corner portion and side wall of the container of FIG. 1.
Figure 13:
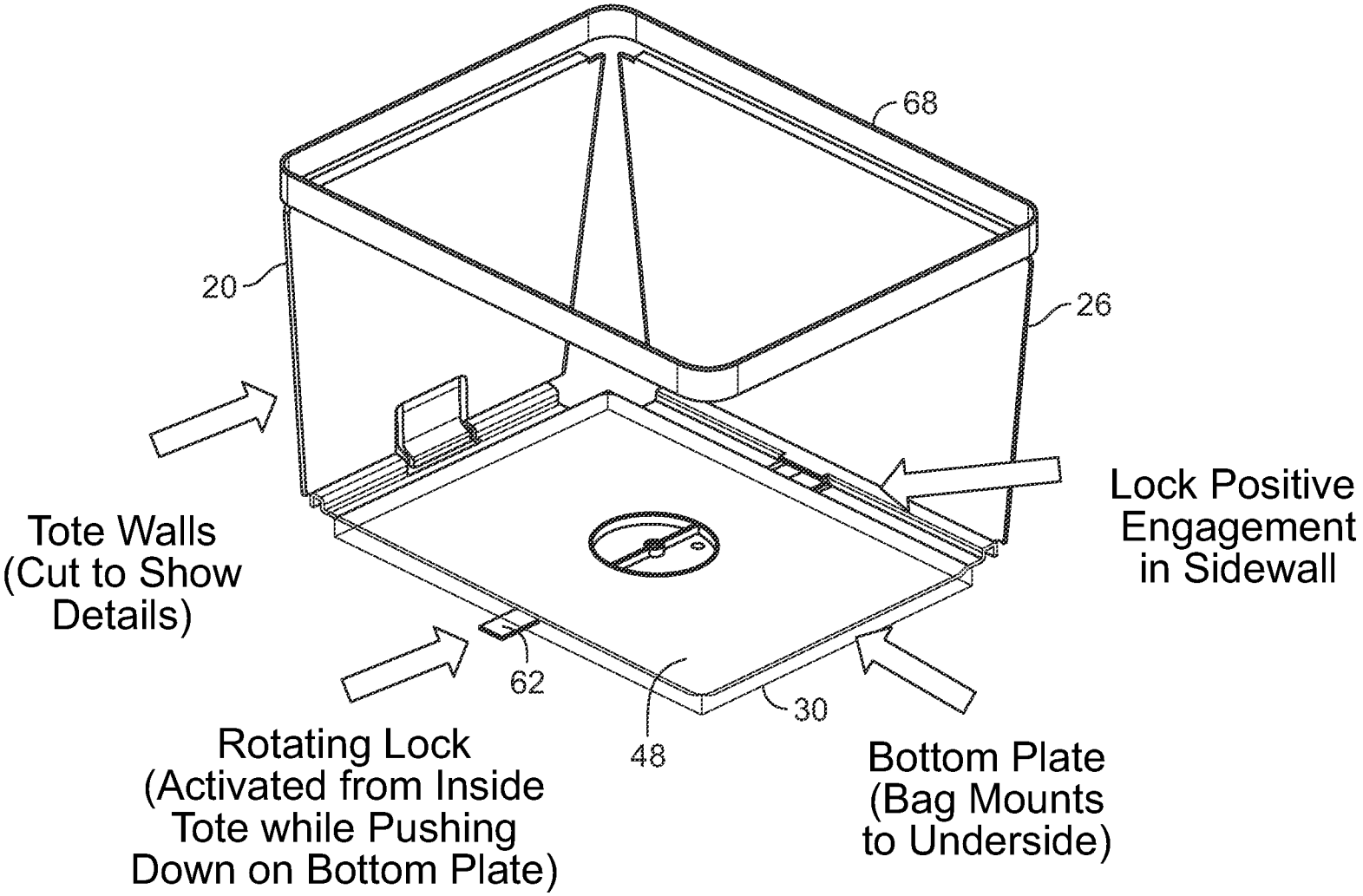
FIG. 13 is a perspective view of the container of FIG. 1 without a front facing side wall and end wall.
Figure 14:
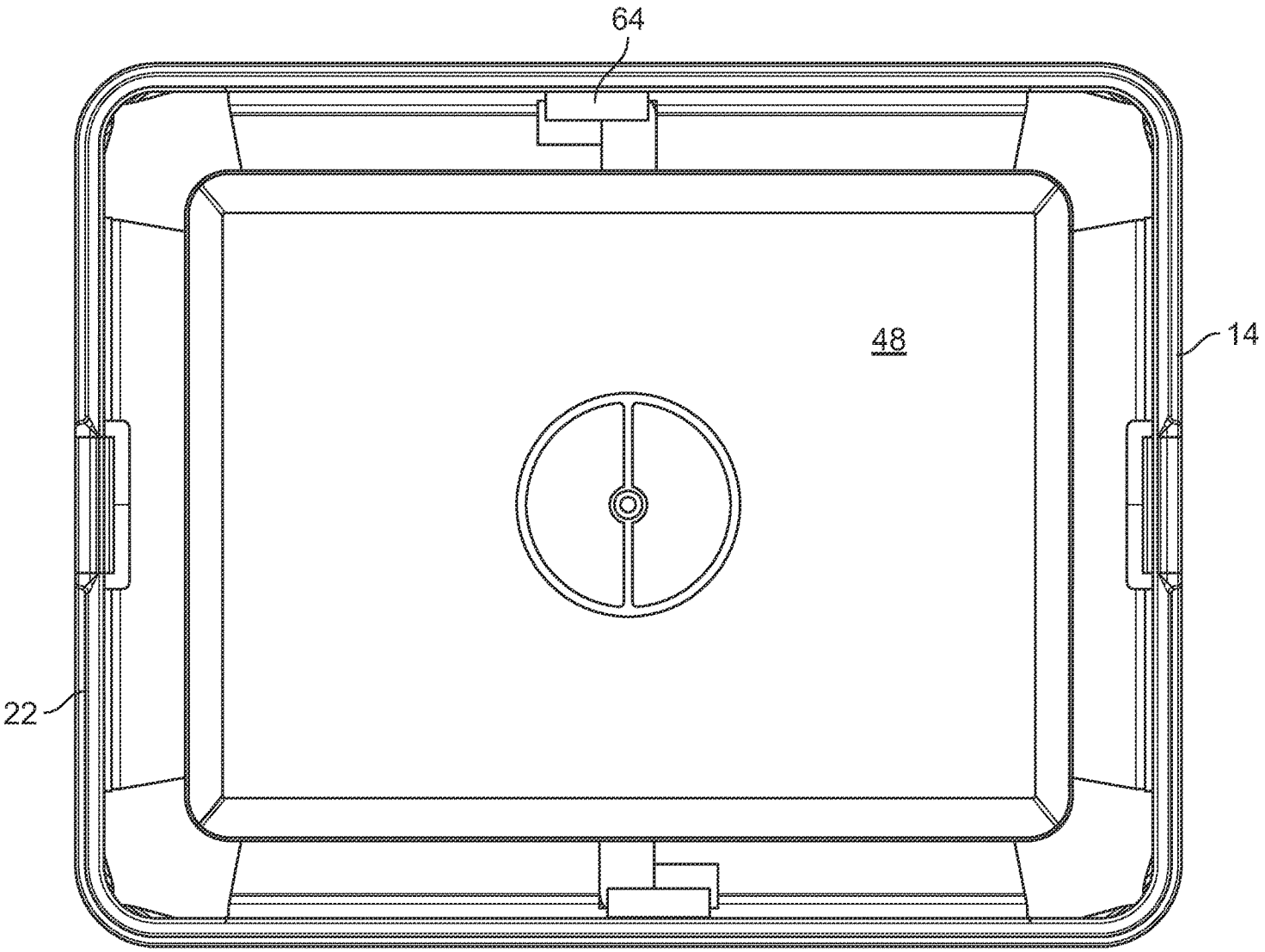
FIG. 14 is a top plan view of a container with a revised latch configuration.
Figure 15:
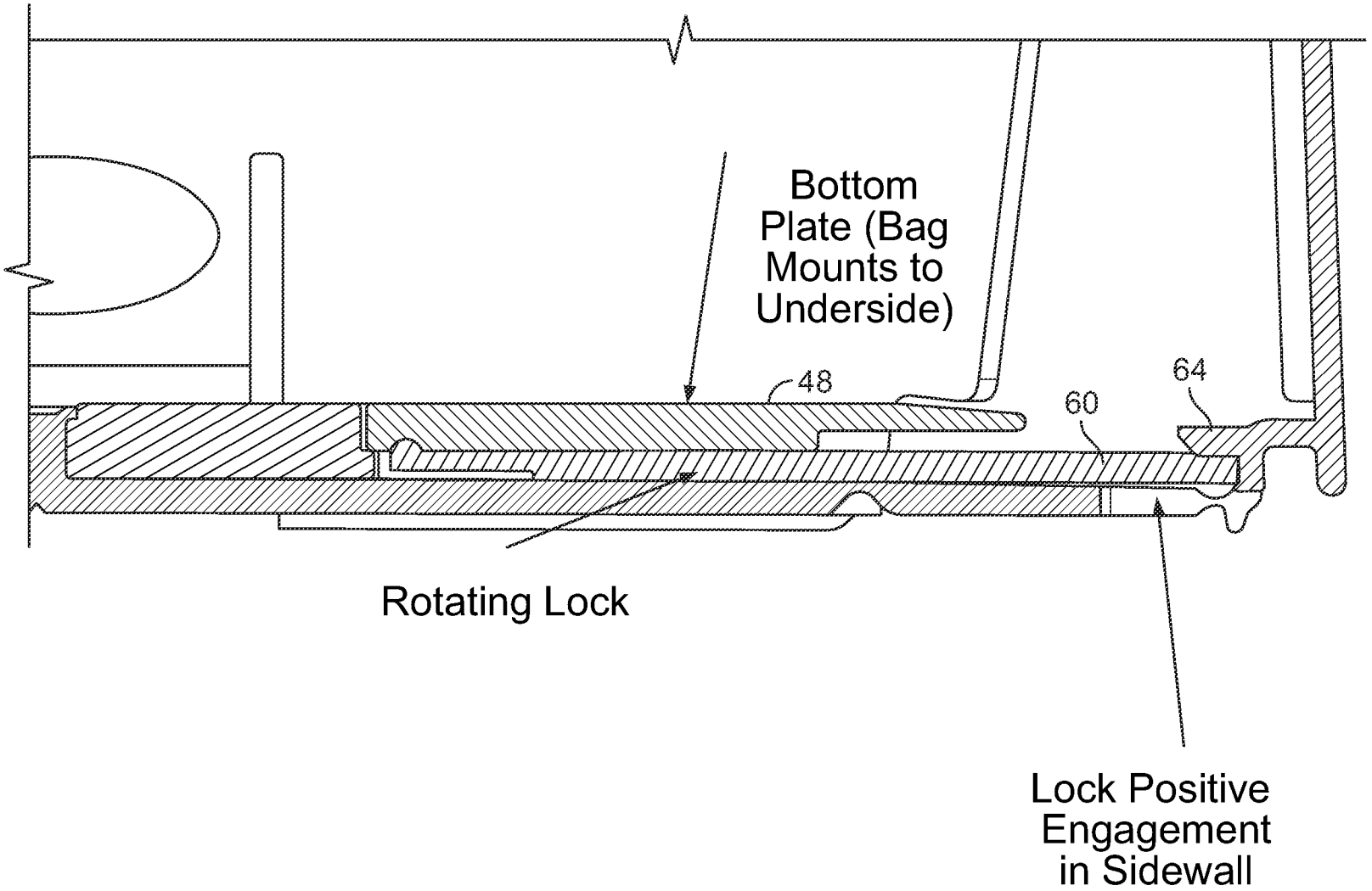
FIG. 15 is a cross-sectional view of the bottom plate and lock of the container of the present invention.

The upper rim 12 of the container 10 can include structure to reinforce this area. FIG. 10 shows a rectangular band 68 that can be used for such reinforcement. The band 68 is shown connected to an inner surface of the rim portion 12. However, it can be configured to be positioned on the outer surface of the rim or internally if the rim is double walled or includes a lip with an overhang.

Figure 16:
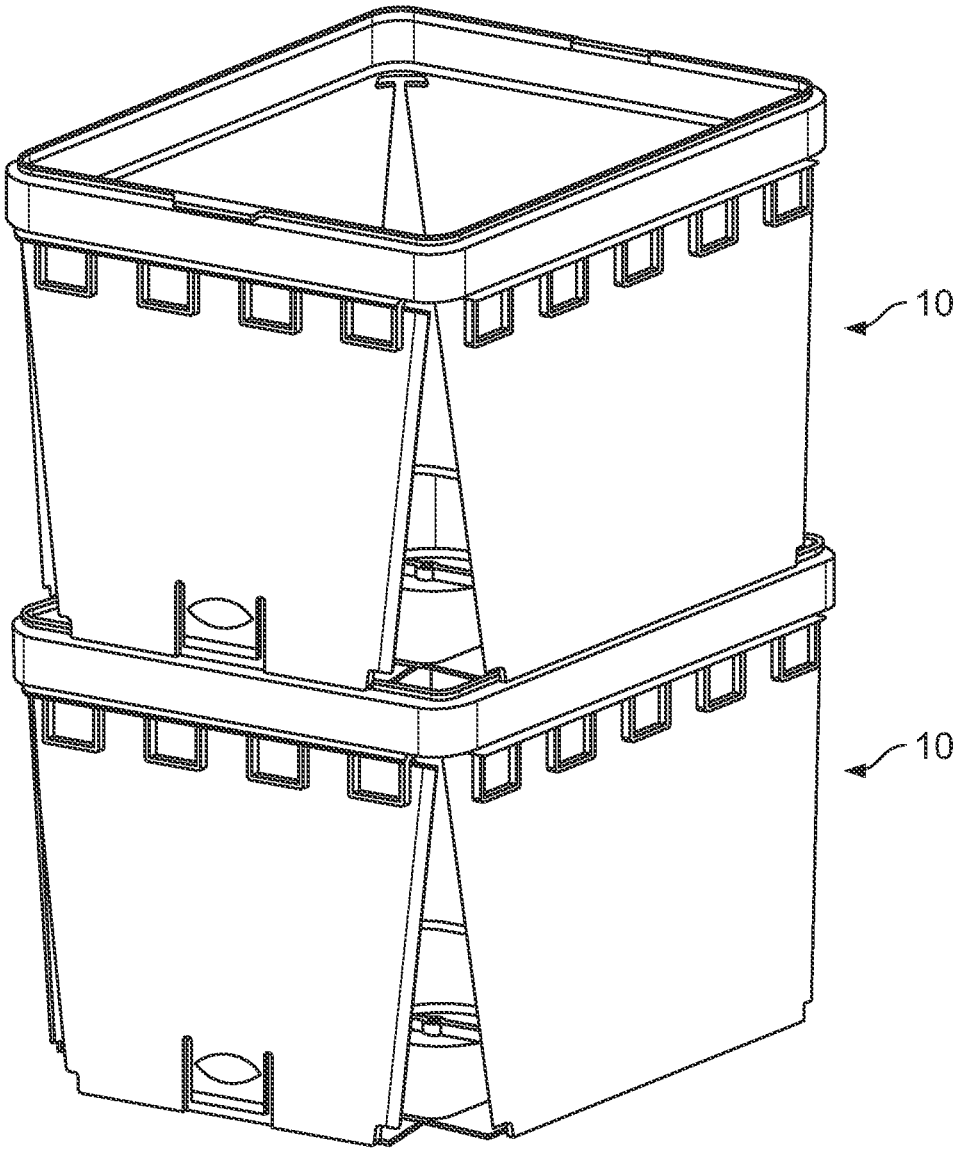
FIG. 16 is a perspective view of two stacked containers with expanded bottom portions in accordance with the present invention.
Figure 17:
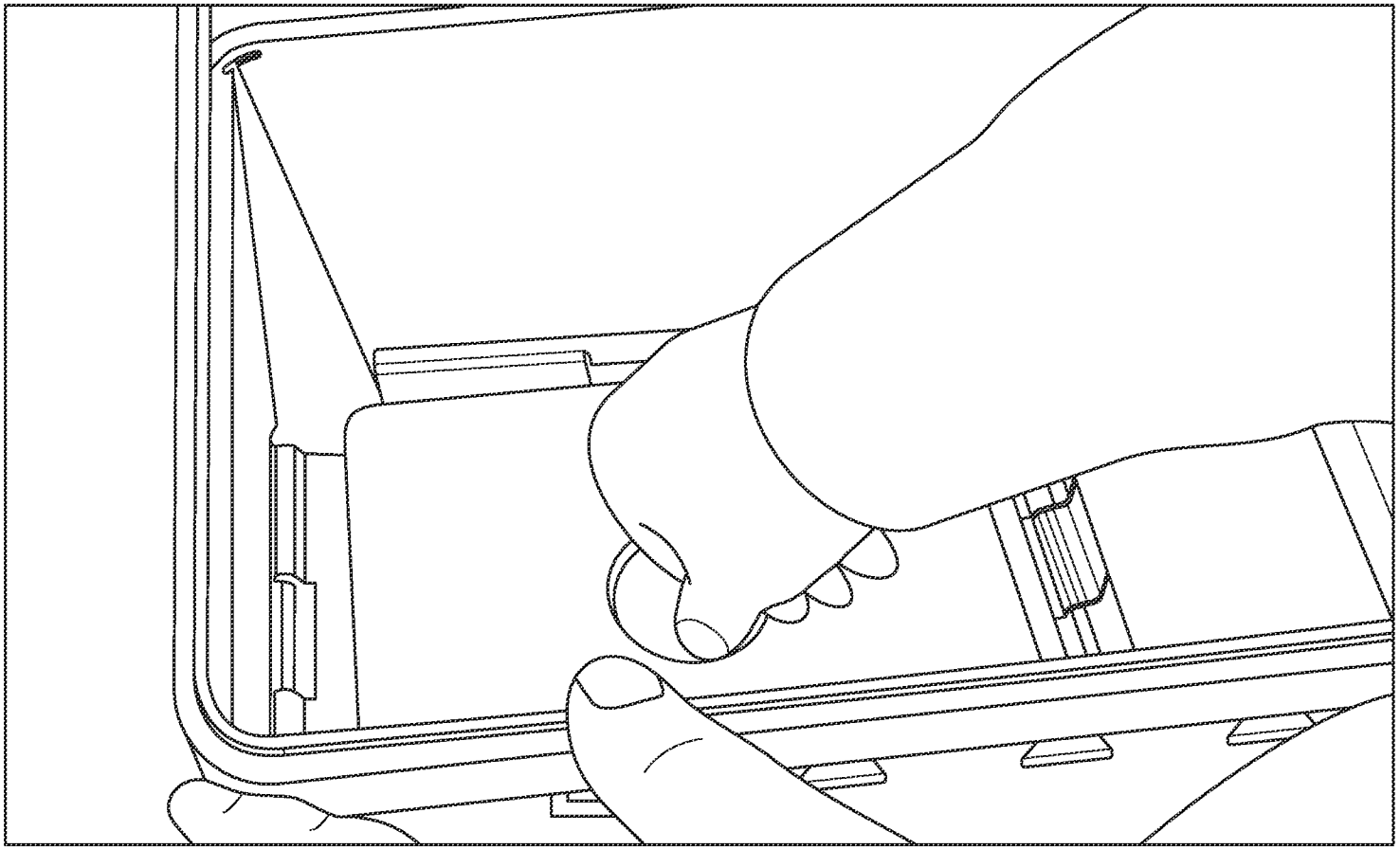
FIG. 17 is a perspective view of an operator engaging the locking mechanism of a container made in accordance with the present invention to expand the side walls of the bottom portion.

The bottom edges of the end walls 14, 22 and side walls 18, 26 include upside down U-shaped structures 70. The U-shaped structures 70 allow the end walls 14, 22 and side walls 18, 26 to firmly grasp the upper edges of the rim portion 12 of a like container when the bottom portion of the container 10 is expanded and stacked on the like container 10. This is shown in FIG. 16 and the left side of FIG. 18.

Figure 18:
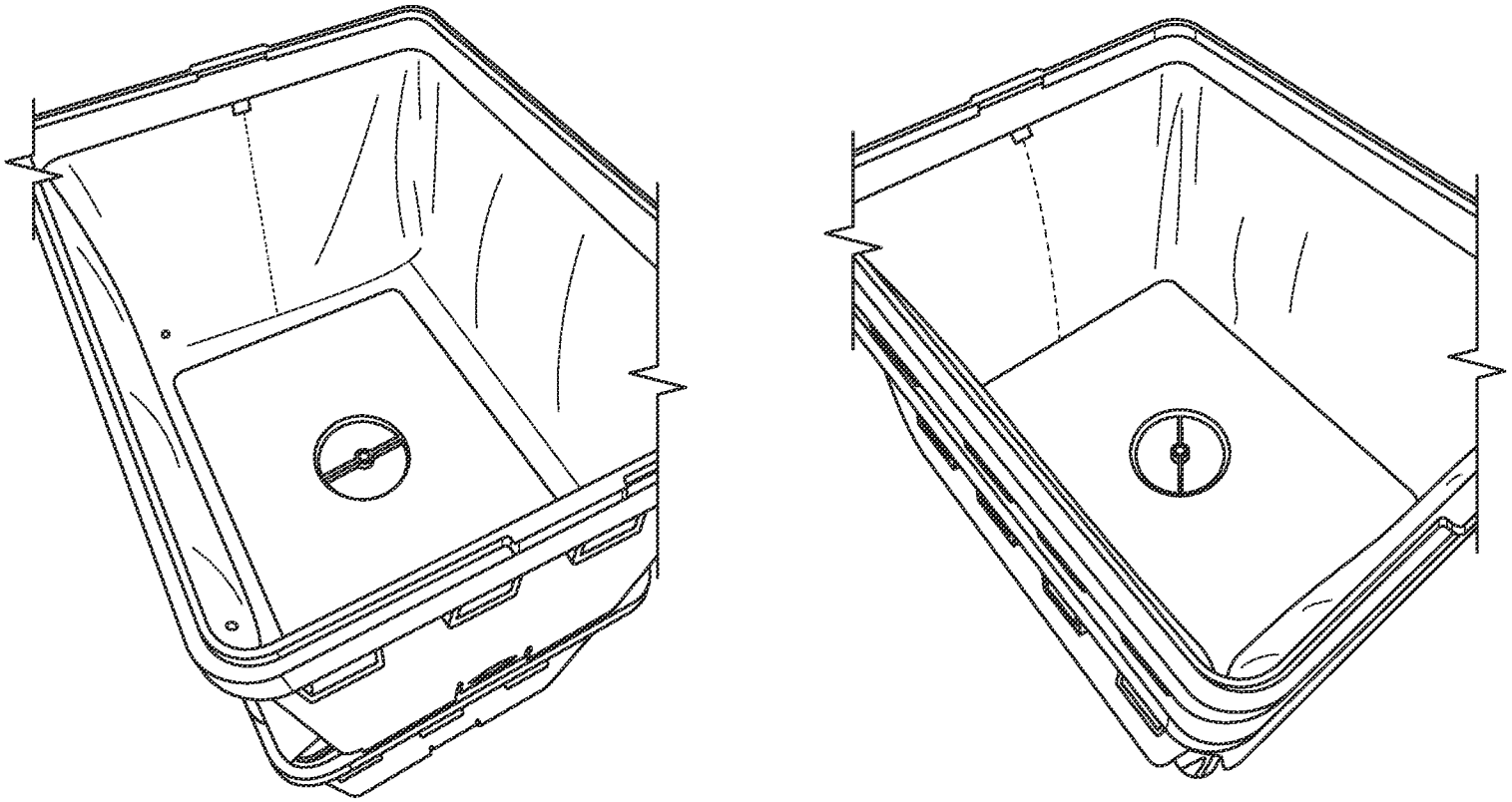
FIG. 18 is a perspective view of two containers with expanded bottom portions stacked (left side) and the two containers with collapsed bottom portions nested (right side)
Figure 19:
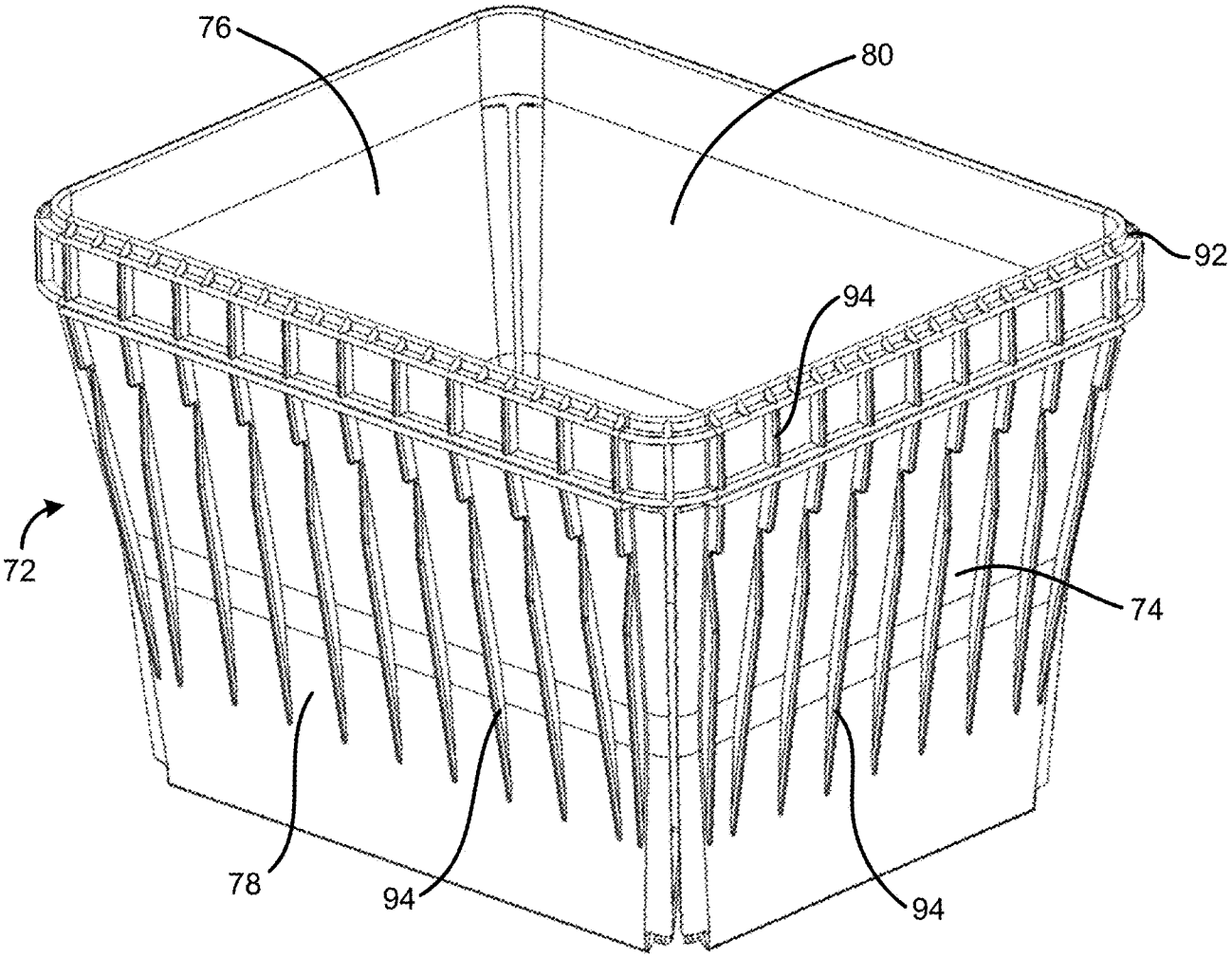
FIG. 19 is a perspective view of another container with an expandable bottom portion made in accordance with the present invention.
Figure 20:
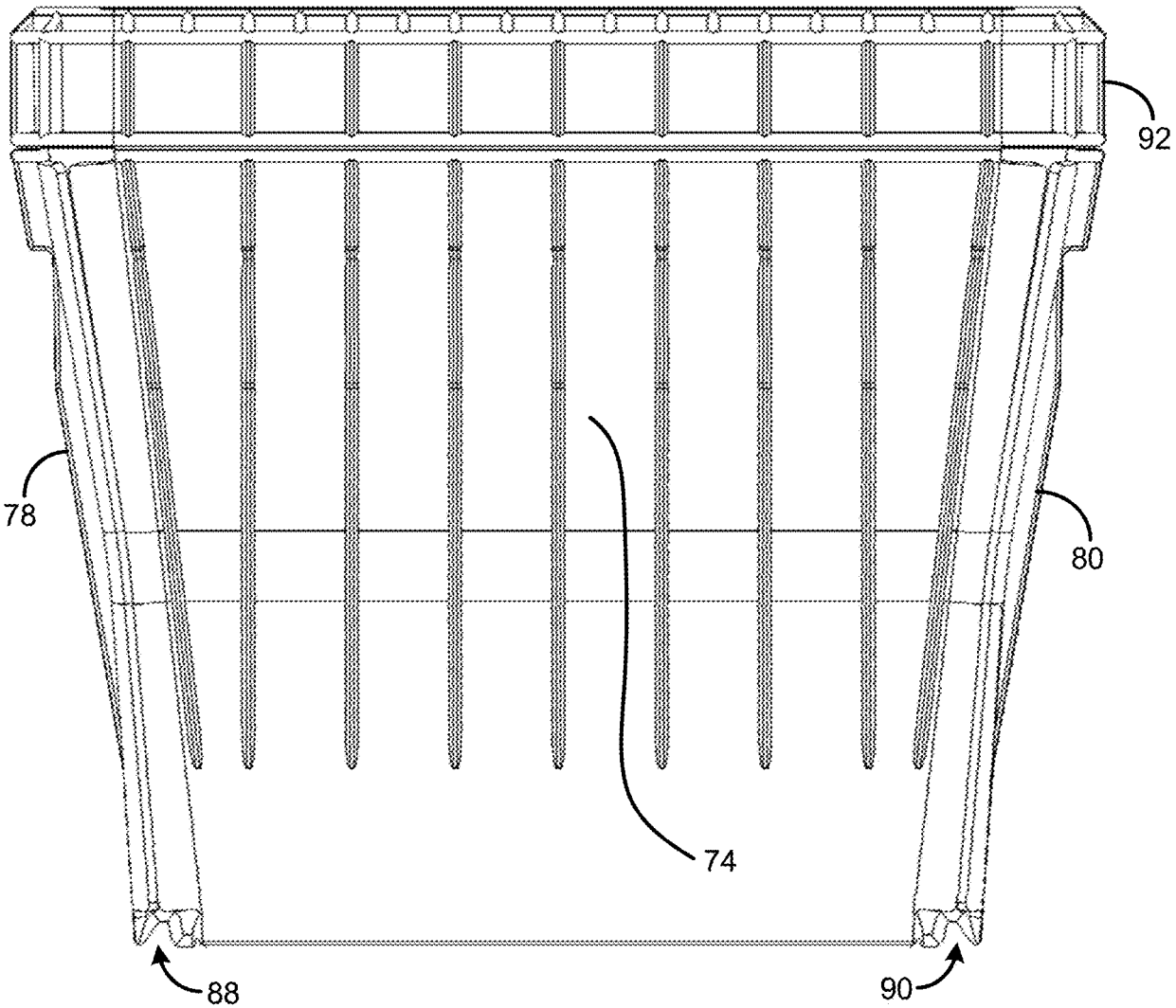
FIG. 20 is an end plan view of the container of FIG. 19.
Figure 21:
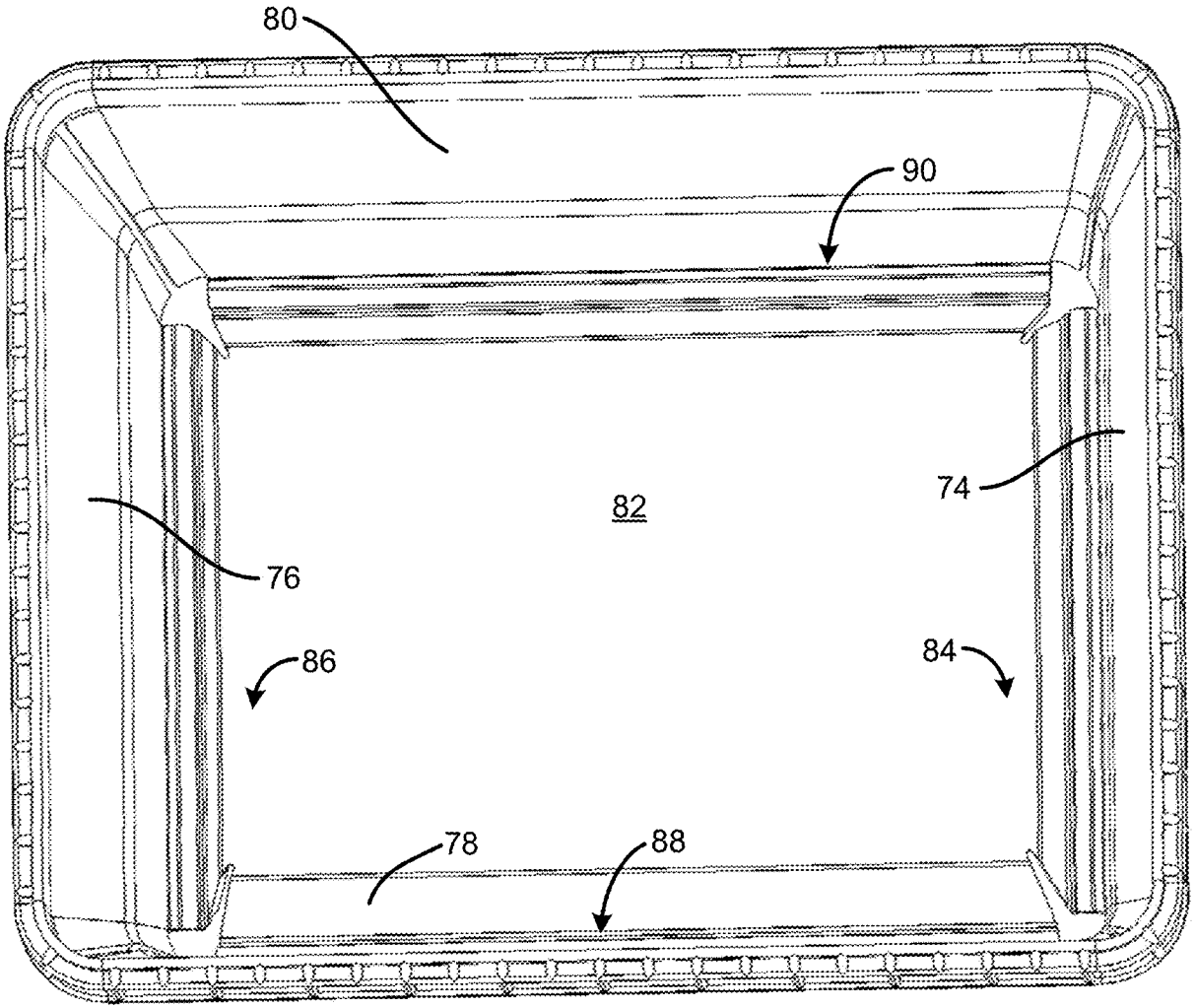
FIG. 21 is a top plan view of the container of FIG. 19.
Figure 22:
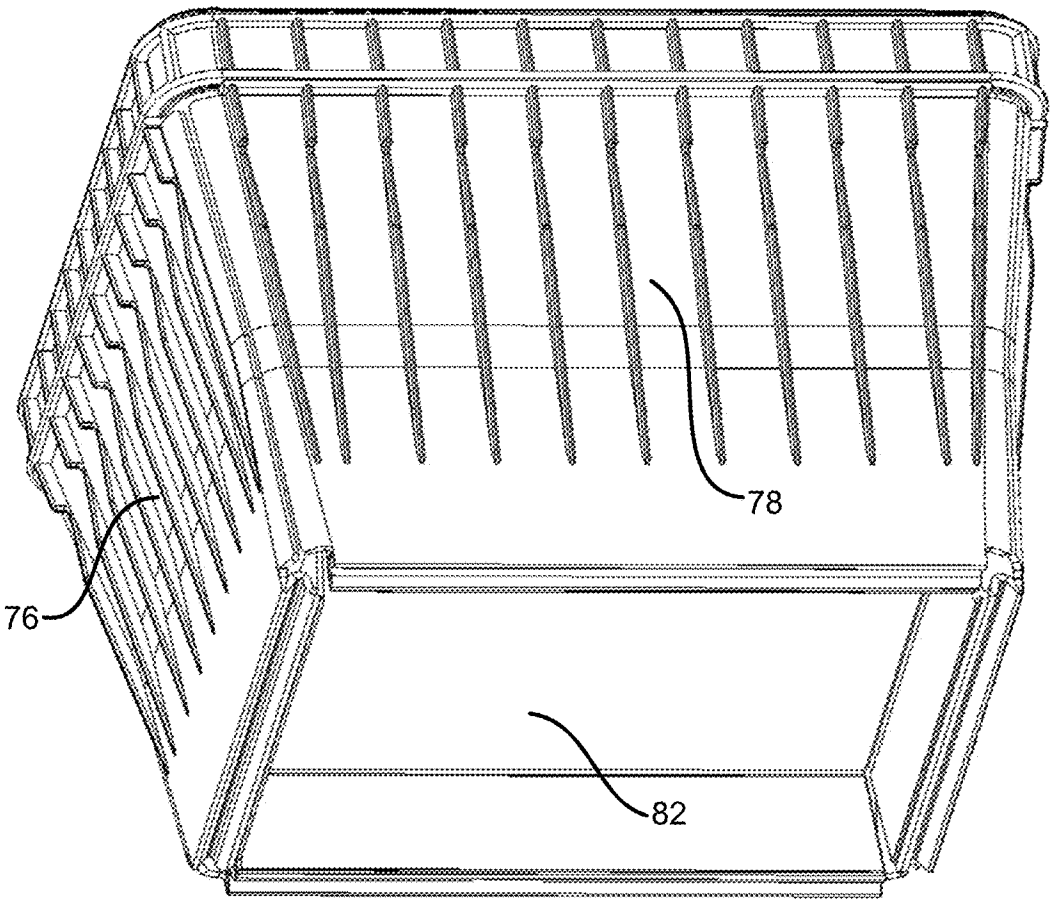
FIG. 22 is a bottom perspective view of the container of FIG. 19.
Figure 23:
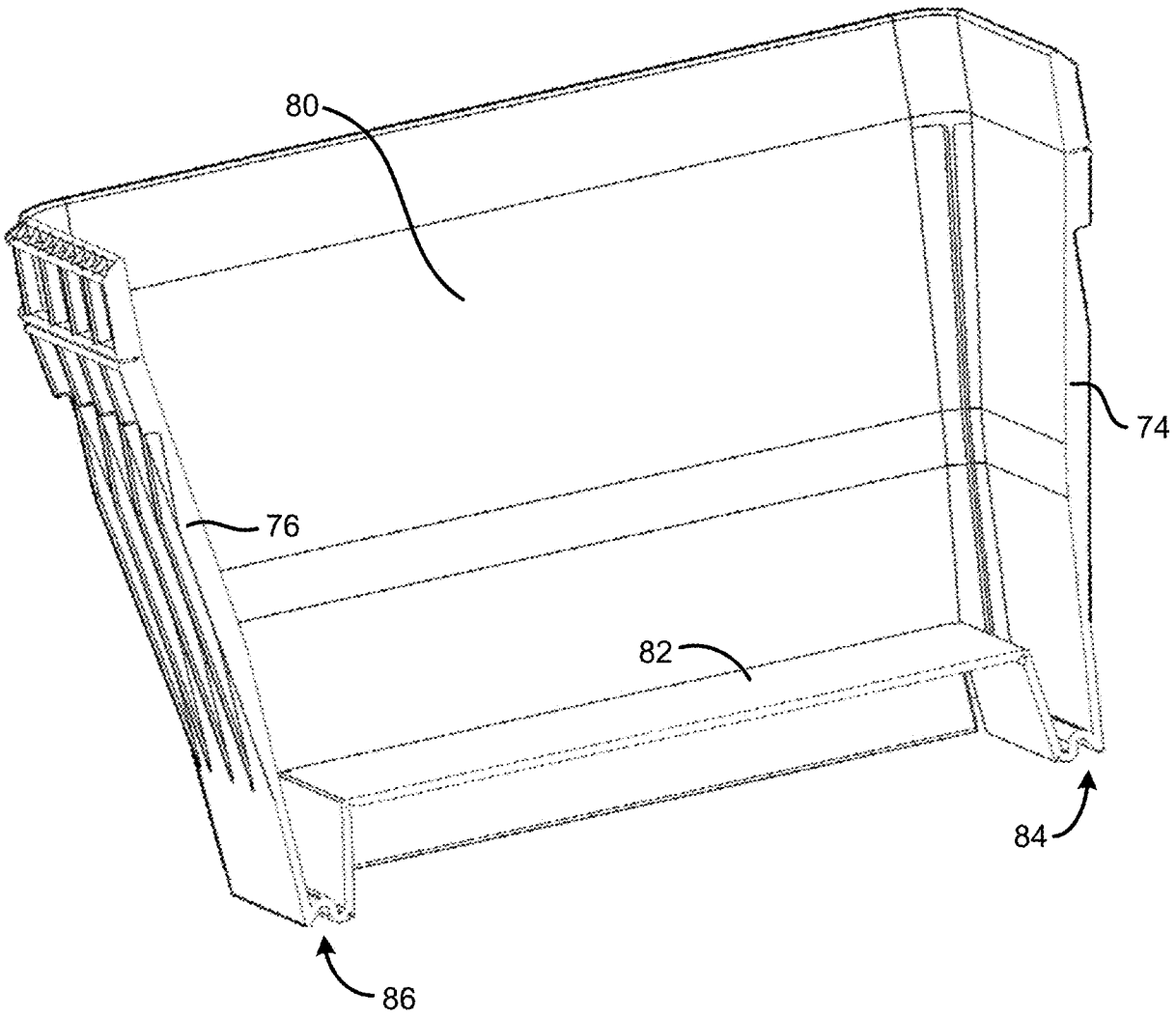
FIG. 23 is a cross-sectional view of the container of FIG. 19.

When the walls are collapsed, the containers can nest as shown on the right side of FIG. 18. Nested containers take up less room and can be more efficiently transported when empty.

FIGS. 19-25 show another container 72 in accordance with the present invention. The container 72 includes a first end wall 74, a second end wall 76, a first side wall 78 and a second side wall 80. A bottom wall 82 is connected to a bottom edge of the first end wall 74 by a first expandable and collapsible linking portion 84. Similarly, the bottom wall 82 is connected to the second end wall by a second expandable and collapsible linking portion 86, and to the first side wall 78 by a third expandable and collapsible linking portion 88 and to the second side wall 80 by a fourth expandable and collapsible linking portion 90.

The container 72 also includes a rim portion 92 connected to the top portions or edges of the first and second end walls 74, 76 and the first and second side walls 78, 80. Both the rim portion 92 and the first and second end walls 74, 76 and the first and second side walls 78, 80, include outwardly extending ribs 94.

Similar to the container 10 of FIGS. 1-18, the container 72 of FIGS. 19-25 also includes a gap 96 between the side edges of the end walls 74, 76 and the side walls 78, 80. The gap 96 has a width that is wider proximate the bottom of the container 72 when the bottom portion is expanded outward (when collapsed, the width could be consistent throughout the height of the end walls and side walls, or non-existent, i.e., the edges could touch or overlap).

Figure 24:
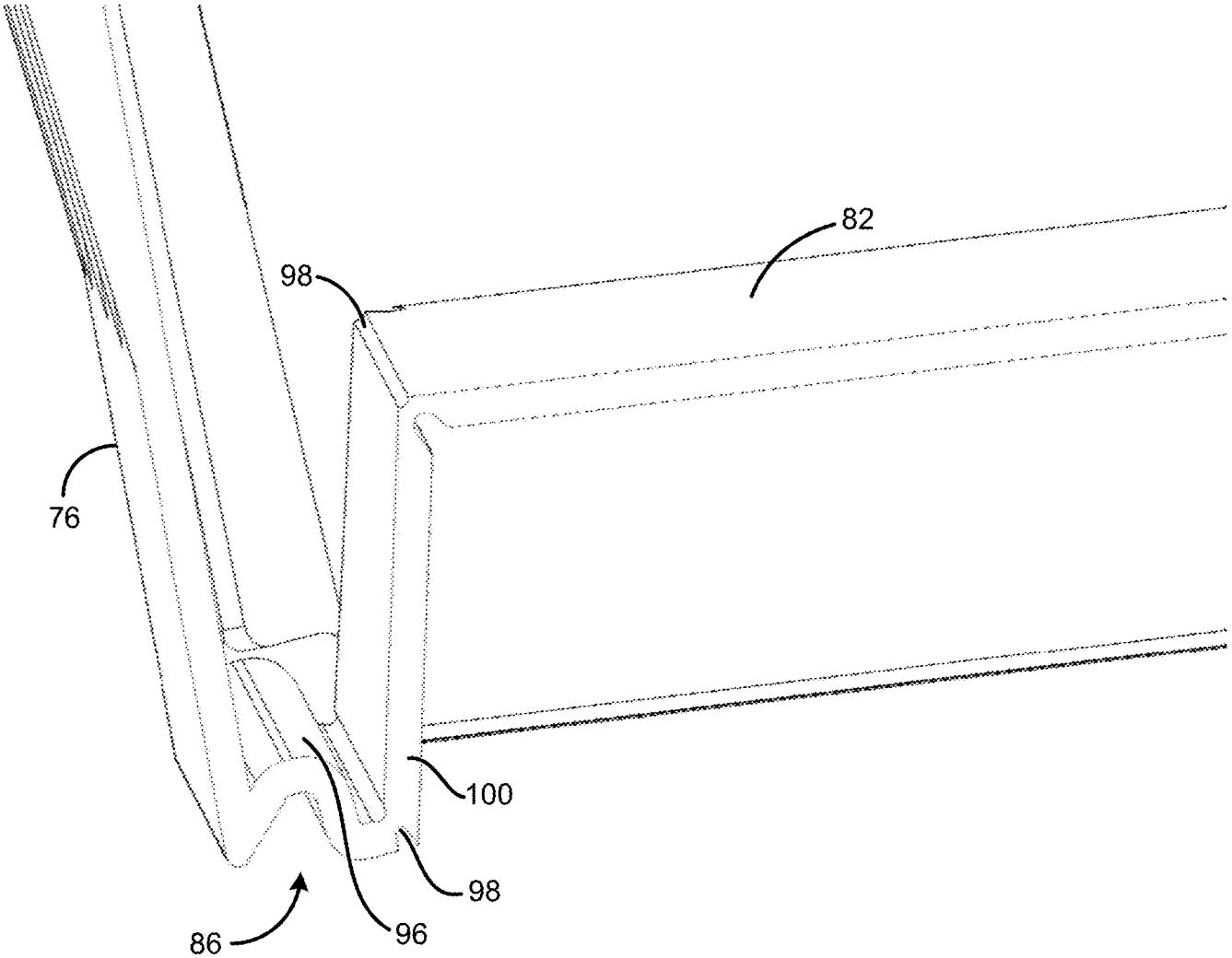
FIG. 24 is an enlarged cross-sectional view the bottom portion of the container of FIG. 19 connected to an end wall; and, FIG. 25 shows two containers of the type shown in FIG. 19 in a stacked position with the bottom portion of the upper container expanded, and in a nested position with the bottom portion of the upper container collapsed.

One expandable and collapsible linking portion 86 is shown enlarged and in cross-section in FIG. 24. The linking portion 86 includes one or more linking segments 96 connected by pivot segments 98. The linking portion 86 also includes a substantially vertical wall 100 connected to the bottom wall 82 by a pivot segment 98. The pivot segments 96 are weakened, or thinned or scored portions or areas that allow the linking segments 96 and/or vertical wall 100 to bend or pivot about such segments. As also evident in FIG. 24, the linking portion 86 forms an upside down U-shaped portion. The upside down U-shape allows the bottom edge of the wall to securely rest on the upper edge or rim of a like container in a stacked configuration when the linking portion is expanded outward.

Figure 25:
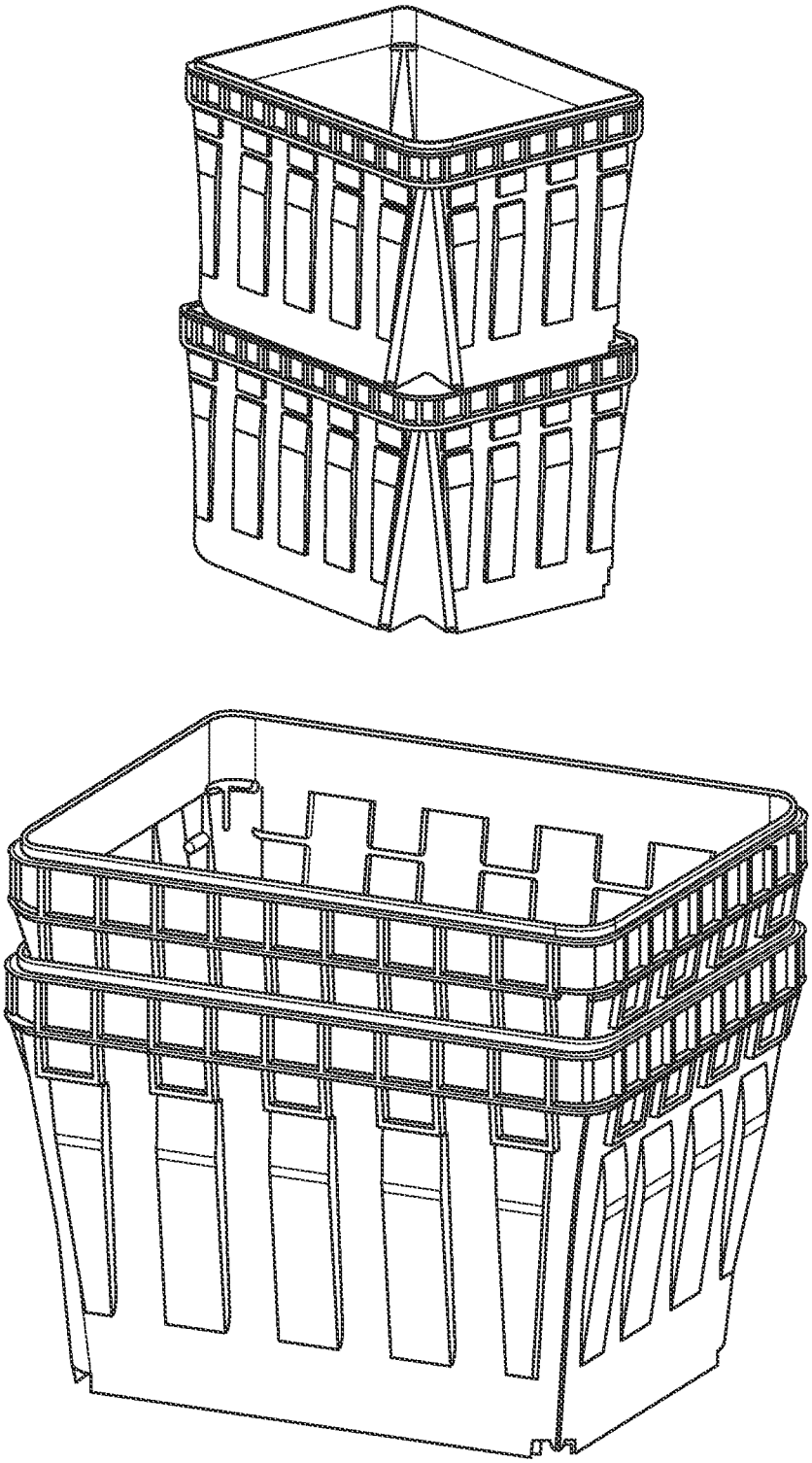

FIG. 25 illustrates two containers 72 in a stacked configuration (top of the Figure) and in a nested configuration (bottom of the Figure). In the stacked configuration, the bottom portion of the top container 72 is expanded so that the bottom edges of the end walls and side walls sit on top of the top edges of the corresponding end walls and side walls of the lower container 72. In the nested configuration, the bottom portion of the top container 72 is collapsed (although not directly visible in the Figure) so that the top container 72 fits within the interior of the lower container 72.

Many modifications and variations of the present invention are possible in light of the above teachings. It is, therefore, to be understood within the scope of the appended claims the invention may be protected otherwise than as specifically described.

I claim:

1. A nestable container with an expandable bottom structure comprising:

a rectangular top rim;

a first end wall extending downward from a first end of the top rim;

a second end wall extending downward from a second end of the top rim opposing the first end of the top rim;

a first side wall extending downward from a first side of the top rim;

a second side wall extending downward from a second side of the top rim opposing the first side of the top rim;

a bottom wall connected to a bottom portion of the first side wall by a first expandable and collapsible linking portion; and, a locking mechanism to lock the first end wall in an expanded position.

2. The nestable container of claim 1 wherein the bottom wall is connected to the second side wall by a second expandable and collapsible linking portion.

3. The nestable container of claim 2 wherein the bottom wall is connected to the first end wall by a third expandable and collapsible linking portion, and wherein the bottom wall is connected to the second end wall by a fourth expandable and collapsible linking portion.

4. The nestable container of claim 3 wherein the locking mechanism locks the second side wall in an expanded position.

5. The nestable container of claim 4 wherein the locking mechanism includes a bottom plate.

6. The nestable container of claim 5 wherein the locking mechanism includes a rotatable lock.

7. The nestable container of claim 6 wherein the rotatable lock includes a central dial, a first arm extending outward from the central dial, and a second arm extending outward from the central dial, and wherein rotation of the dial causes the first and second arms to one of engage and disengage the first and second side walls.

8. The nestable container of claim 7 wherein the first side wall includes a first catch for engaging an end of the first arm of the rotatable lock when rotated to engage the first side wall and lock the first side wall into an expanded position.

9. The nestable container of claim 1 wherein the bottom wall includes a plurality of downwardly extending ribs.

10. The nestable container of claim 1 wherein the container is formed from plastic.

11. The nestable container of claim 1 further comprising a first gap between the first end wall and the first side wall, the first gap having a first width proximate a bottom of the first end wall and a bottom of the first side wall and a second width proximate a top of the first end wall and a top of the first side wall, wherein the first width is greater than the second width.

12. The nestable container of claim 1 wherein the first end wall includes a tab for enabling a user to one of expand and collapse a bottom portion of the first end wall.

13. The nestable container of claim 1 further comprising a support band connected to the top rim.

14. A nestable container with an expandable and collapsible bottom portion comprising:

a rectangular bottom wall;

a first end wall connected to a first side of the bottom wall by a first expandable and collapsible linking portion;

a second end wall connected to a second side of the bottom wall by a second expandable and collapsible linking portion;

a first side wall connected to a third side of the bottom wall by a third expandable and collapsible linking portion;

a second side wall connected to a fourth side of the bottom wall by a fourth expandable and collapsible linking portion; and, a mechanism for locking the first side wall and the second side wall in an expanded position.

15. The nestable container of claim 14 further comprising a rectangular rim connected to a top portion of the first end wall, a top portion of the second end wall, a top portion of the first side wall and a top portion of the second side wall.

16. The nestable container of claim 14 wherein the first expandable and collapsible linking portion includes a first linking segment and a second linking segment connected to the first linking segment by a pivot portion.

17. The nestable container of claim 16 wherein the first linking segment is connected to a bottom edge of the first end wall by a pivot portion.

18. The nestable container of claim 17 wherein the second linking segment is connected to an interior vertical bottom wall by a pivot portion.

19. The nestable container of claim 18 wherein the interior vertical wall segment is connected to the first side of the bottom wall by a pivot portion.

20. The nestable container of claim 14 wherein the container is formed from plastic.

* * * * *